US011841655B2

(12) United States Patent
Umeda et al.

(10) Patent No.: US 11,841,655 B2
(45) Date of Patent: Dec. 12, 2023

(54) IMAGE HEATING DEVICE

(71) Applicant: CANON KABUSHIKI KAISHA, Tokyo (JP)

(72) Inventors: Kensuke Umeda, Kawasaki (JP); Masashi Tanaka, Kawasaki (JP); Shoichiro Ikegami, Yokohama (JP); Sho Taguchi, Fujisawa (JP); Ai Suzuki, Tokyo (JP); Hikaru Osada, Kamakura (JP); Toru Imaizumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 473 days.

(21) Appl. No.: 17/070,750

(22) Filed: Oct. 14, 2020

(65) Prior Publication Data

US 2021/0026280 A1 Jan. 28, 2021

Related U.S. Application Data

(63) Continuation of application No. 15/650,735, filed on Jul. 14, 2017, now Pat. No. 10,838,332.

(30) Foreign Application Priority Data

Jul. 21, 2016 (JP) ..... 2016-143006
Jul. 21, 2016 (JP) ..... 2016-143010

(51) Int. Cl.

| | |
|---|---|
| ***G03G 15/20*** | (2006.01) |
| ***H05B 3/00*** | (2006.01) |
| ***G03G 15/00*** | (2006.01) |
| ***G03G 21/16*** | (2006.01) |

(52) U.S. Cl.
CPC ..... *G03G 15/2053* (2013.01); *G03G 15/2064* (2013.01); *G03G 15/6555* (2013.01); *G03G 21/1604* (2013.01); *H05B 3/0095* (2013.01)

(58) Field of Classification Search
CPC ..... G03G 15/2053; G03G 15/2064; G03G 15/6555; G03G 21/1604; H05B 3/0095
USPC ..... 219/216
See application file for complete search history.

(56) References Cited

U.S. PATENT DOCUMENTS 4,533,231 A * 8/1985 Shigenobu ..... G03G 15/206 399/331
5,195,430 A * 3/1993 Rise ..... G03B 27/32 100/168
5,270,777 A * 12/1993 Yoshida ..... G03G 15/2053 399/333

(Continued)

*Primary Examiner* — Jimmy Chou
(74) *Attorney, Agent, or Firm* — Canon U.S.A., Inc. IP Division

(57) ABSTRACT

A fixing device includes a heating rotating member having a conductive layer and an exposed portion in which the conductive layer is partially exposed, and a roller including a metal core and an elastic portion, the roller forming a nip portion with the heating rotating member, the elastic portion being elastically deformed in a region where the nip portion is formed, wherein an annular conductive member provided in a longitudinal end portion of the metal core is in contact with the exposed portion of the heating rotating member while elastically deformed, and wherein in a state where the roller is not mounted to the fixing device, an outer diameter of the conductive member is smaller than an outer diameter of the elastic portion.

15 Claims, 20 Drawing Sheets

(56) References Cited

U.S. PATENT DOCUMENTS 5,404,214 A * 4/1995 Yoshimoto ..... G03G 15/206 399/329
6,054,677 A * 4/2000 Morigami ..... G03G 15/2053 399/330
6,459,878 B1 * 10/2002 Tomoyuki ..... G03G 15/206 29/895.32
6,505,028 B1 * 1/2003 Yoda ..... G03G 15/2025 399/329
6,671,488 B2 * 12/2003 Izawa ..... G03G 15/2064 399/329
6,961,532 B2 * 11/2005 Uekawa ..... G03G 15/2053 399/329
7,194,234 B2 * 3/2007 Katakabe ..... G03G 15/2057 219/216
7,203,453 B2 * 4/2007 Naito ..... G03G 15/2053 399/329
8,014,711 B2 * 9/2011 Ito ..... G03G 15/2039 219/219
8,351,836 B2 * 1/2013 Yonekawa ..... G03G 15/2053 399/333
8,634,740 B2 * 1/2014 Sakai ..... G03G 15/2053 399/329
8,666,268 B2 * 3/2014 Watanabe ..... G03G 15/205 219/544
8,818,254 B2 * 8/2014 Arimoto ..... G03G 15/2053 399/329
8,971,781 B2 * 3/2015 Nakajima ..... G03G 15/2057 399/333
8,998,786 B2 * 4/2015 Imasaka ..... G03G 15/1685 492/59
9,195,188 B2 * 11/2015 Gon ..... G03G 15/2053
9,217,971 B1 * 12/2015 Matsumoto ..... G03G 15/2053
10,466,631 B1 * 11/2019 Owaki ..... G03G 15/2057
2001/0028818 A1 * 10/2001 Takahashi ..... G03G 15/2053 399/333
2002/0110394 A1 * 8/2002 Takeuchi ..... G03G 15/2064 399/328
2002/0150412 A1 * 10/2002 Nakayama ..... G03G 15/2053 432/60
2002/0159784 A1 * 10/2002 Yoshioka ..... G03G 15/1675 399/66
2002/0168202 A1 * 11/2002 Izawa ..... G03G 15/2064 399/329
2003/0038125 A1 * 2/2003 Kataoka ..... G03G 15/2053 219/469
2003/0152405 A1 * 8/2003 Takeuchi ..... G03G 15/2053 399/328
2003/0196999 A1 * 10/2003 Kato ..... H05B 3/0095 219/216
2004/0239749 A1 * 12/2004 Kagawa ..... G03G 15/2017 347/156
2005/0031389 A1 * 2/2005 Tsueda ..... G03G 15/2064 399/333
2005/0152720 A1 * 7/2005 Katakabe ..... G03G 15/2057 399/330
2006/0029444 A1 * 2/2006 Naito ..... G03G 15/2053 399/329
2006/0049175 A1 * 3/2006 Yokota ..... G03G 15/2053 219/619
2006/0182474 A1 * 8/2006 Naito ..... G03G 15/2053 399/329
2007/0201914 A1 * 8/2007 Tsuji ..... G03G 15/2053 399/329
2008/0187373 A1 * 8/2008 Tsueda ..... G03G 15/2053 399/330
2010/0119269 A1 * 5/2010 Kondoh ..... G03G 15/2053 430/127
2011/0013956 A1 * 1/2011 Yonekawa ..... G03G 15/2057 219/538
2011/0026987 A1 * 2/2011 Hasegawa ..... G03G 15/2017 399/329
2011/0058865 A1 * 3/2011 Tokuda ..... G03G 15/2053 399/329
2011/0064437 A1 * 3/2011 Yamashina ..... G03G 15/205 399/329
2011/0182638 A1 * 7/2011 Ishii ..... G03G 15/2053 399/333
2011/0222931 A1 * 9/2011 Shinshi ..... G03G 15/2064 399/329
2011/0222932 A1 * 9/2011 Hayase ..... G03G 15/2064 399/329
2011/0293309 A1 * 12/2011 Hase ..... G03G 15/2039 399/69
2012/0020709 A1 * 1/2012 Uchiyama ..... G03G 15/206 399/333
2012/0093547 A1 * 4/2012 Baba ..... G03G 15/2032 399/329
2012/0155936 A1 * 6/2012 Yamaguchi ..... G03G 15/2053 399/329
2012/0177424 A1 * 7/2012 Saito ..... G03G 15/2039 399/334
2012/0201582 A1 * 8/2012 Shimura ..... G03G 15/2042 399/329
2012/0230742 A1 * 9/2012 Nakagawa ..... B32B 27/34 399/329
2012/0243894 A1 * 9/2012 Umeda ..... G03G 15/2032 399/68
2012/0243922 A1 * 9/2012 Uehara ..... G03G 15/2053 399/329
2012/0308255 A1 * 12/2012 Sakai ..... G03G 15/2053 399/329
2012/0328340 A1 * 12/2012 Iwai ..... G03G 15/2053 399/329
2013/0045021 A1 * 2/2013 Yoshioka ..... G03G 15/5041 399/69
2013/0119052 A1 * 5/2013 Yamamoto ..... G03G 15/2042 219/660
2013/0216282 A1 * 8/2013 Ohtsu ..... G03G 15/2053 399/329
2013/0223903 A1 * 8/2013 Matsuura ..... G03G 15/2053 399/329
2013/0259548 A1 * 10/2013 Matsumoto ..... G03G 15/2057 399/333
2014/0053393 A1 * 2/2014 Lee ..... G03G 15/2057 219/534
2014/0056626 A1 * 2/2014 Sakai ..... G03G 15/2053 399/329
2014/0064768 A1 * 3/2014 Kirikubo ..... G03G 15/205 219/618
2014/0072321 A1 * 3/2014 Ooyanagi ..... G03G 15/2039 399/69
2014/0119789 A1 * 5/2014 Miyahara ..... G03G 15/206 156/64
2014/0126940 A1 * 5/2014 Son ..... H05B 3/145 399/333
2014/0205332 A1 * 7/2014 Otsu ..... G03G 15/2053 399/329
2014/0286663 A1 * 9/2014 Yamamoto ..... G03G 15/2042 399/69
2014/0308052 A1 * 10/2014 Narahara ..... G03G 15/2053 399/329
2014/0314458 A1 * 10/2014 Mitani ..... G03G 15/2017 399/329
2015/0023704 A1 * 1/2015 Imaizumi ..... G03G 15/2053 399/329
2015/0030360 A1 * 1/2015 Saiki ..... G03G 15/2053 399/329
2015/0153690 A1 * 6/2015 Suzuki ..... G03G 15/2053 399/329
2015/0168881 A1 * 6/2015 Obata ..... G03G 15/2053 399/329
2015/0234331 A1 * 8/2015 Gon ..... G03G 15/2057 399/333
2015/0261157 A1 * 9/2015 Yamano ..... G03G 15/2053 399/329
2015/0309457 A1 * 10/2015 Gon ..... G03G 15/2053 399/329

(56) References Cited

U.S. PATENT DOCUMENTS

2015/0338804 A1* 11/2015 Nakashima ..... H05B 3/141
219/216
2015/0338805 A1* 11/2015 Nakayama ..... H05B 3/06
219/216
2015/0341985 A1* 11/2015 Nakayama ..... H05B 3/03
219/216
2015/0341986 A1* 11/2015 Nakayama ..... H05B 3/03
219/216
2015/0355581 A1* 12/2015 Matsunaka ..... C08K 5/56
427/444
2016/0029435 A1* 1/2016 Kakubari ..... H05B 3/22
219/216
2016/0098001 A1* 4/2016 Ogawa ..... G03G 15/2053
399/338
2016/0098002 A1* 4/2016 Yashiro ..... G03G 15/2053
399/329
2016/0132007 A1* 5/2016 Eiki ..... G03G 15/2053
399/329
2016/0132009 A1* 5/2016 Yashiro ..... G03G 21/1647
399/329
2016/0187823 A1* 6/2016 Seto ..... G03G 15/2042
399/329
2016/0195838 A1* 7/2016 Matsunaka ..... G03G 15/2057
427/379
2017/0102651 A1* 4/2017 Tanaka ..... G03G 15/2053
2017/0219969 A1* 8/2017 Umeda ..... G03G 15/2039
2017/0308025 A1* 10/2017 Suzuki ..... G03G 15/5008
2018/0024478 A1* 1/2018 Akamatsu ..... G03G 15/5004
399/33
2018/0203390 A1* 7/2018 Honke ..... G03G 15/2028
2018/0275574 A1* 9/2018 Yoshida ..... G03G 9/0819
2018/0299807 A1* 10/2018 Matsuura ..... G03G 15/6594
2018/0348667 A1* 12/2018 Omata ..... G03G 15/0865
2019/0137909 A1* 5/2019 Umeda ..... G03G 15/1665

* cited by examiner

PRESENT EXEMPLARY EMBODIMENT

COMPARATIVE EXAMPLE

IMAGE HEATING DEVICE

CROSS-REFERENCE TO RELATED APPLICATIONS

The present application is a continuation of U.S. patent application Ser. No. 15/650,735, filed on Jul. 14, 2017, which claims priority from Japanese Patent Application No. 2016-143006 filed Jul. 21, 2016 and Japanese Patent Application No. 2016-143010 filed Jul. 21, 2016, which are hereby incorporated by reference herein in their entireties.

BACKGROUND OF THE INVENTION

Field of the Invention

Aspects of the present disclosure generally relate to an image forming apparatus and, more particularly, to an image heating device for heating a toner image on a recording material. The image heating device can be used as a fixing device in an image forming apparatus using an electrophotographic method, such as a copying machine, a printer, a fax, or a multifunction peripheral having the functions of these apparatuses.

Description of the Related Art

Conventionally, in an image forming apparatus as described above, a device using a film heating method is put to practical use as a fixing device for, in an image formation process unit, heating and fixing an unfixed toner image formed and borne on a recording material (hereinafter referred to as a "sheet" or "paper") according to desired image information.

This fixing device presses a fixing film (hereinafter referred to as a "film") serving as a heating member to bring the film into close contact with a heater (a heating body), using a pressurization member, thereby causing the film to run. Then, the fixing device introduces a sheet into a pressure contact nip portion (a fixing nip portion) formed across the film by the heater and the pressurization member, brings the sheet into close contact with the film, and passes the sheet through the fixing nip portion together with the film. Consequently, the fixing device imparts heat from the heater to the sheet through the film, thereby heating an unfixed toner image and fixing the unfixed toner image to the surface of the sheet.

In a fixing device using a film heating method, particularly when a dry sheet having high electrical resistance is passed through the fixing device, the surface of a film may be charged to a polarity opposite to the charge polarity of toner due to the friction between the sheet and the film. At this time, if a sheet bearing a toner image is passed, the force of the sheet electrostatically holding toner decreases. Thus, a phenomenon where unfixed toner transfers to the film side (electrostatic offset) may occur.

To prevent such electrostatic offset, Japanese Patent Application Laid-Open No. 6-202509 discusses the following configuration. That is, a conductive surface is exposed in part of a film and brought into contact with a conductive elastic body provided on a metal core of a pressure roller serving as a driving rotating member, in a pressure contact nip portion between the film and the pressure roller. Then, the metal core is connected to the earth, thereby preventing the surface of the film from being charged. In this configuration, to bring the conductive elastic body into stable contact with the film, the outer diameter of the conductive elastic body is made larger than the outer diameter of the pressure roller.

In a fixing device as described above, when the film and the pressure roller are in contact with each other, the film is lifted up on the conductive elastic body side and inclined relative to the pressure roller. In the state where the film is inclined, then on the conductive elastic body side, the amount of crush of the pressure roller is small, and therefore, the outer diameter of the pressure roller becomes large. On the opposite side, the amount of crush of the pressure roller is great, and therefore, the outer diameter of the pressure roller becomes small. Thus, by the rotation of the pressure roller, the film is sent faster on the conductive elastic body side. Consequently, the force of going to the conductive elastic body side occurs in the film.

Meanwhile, in recent years, to downsize a product, the distances between a conveying roller, a transfer unit, and a fixing unit are shortened in the conveyance of a sheet. In each unit, an inclination occurs in a sheet conveying direction due to product tolerance. If a sheet is conveyed in a unit having an inclination, a force corresponding to the inclination acts also in a direction perpendicular to the conveying direction. At this time, if the sheet is nipped by the fixing unit, a film receives a force in the longitudinal direction from the sheet. The force received by the film continues until the sheet comes out of the transfer unit. Thus, if the distance between the fixing unit and the transfer unit is short, the distance to the position where the sheet comes out of the transfer unit becomes long. Thus, the force of the film going to one side becomes great.

If the directions of the force of a conductive elastic member acting on a film and the force acting on the film by the conveyance of a sheet due to the downsizing of a product are the same direction, the force acting on the film becomes greater. This increases the possibility that the film strongly hits a flange member for regulating the film, and the film is buckled.

SUMMARY OF THE INVENTION

According to an aspect of the present disclosure, a fixing device for fixing a toner image on a recording material includes a heating rotating member including a conductive layer and an exposed portion in which the conductive layer is partially exposed, a roller including a metal core and an elastic portion formed outside the metal core, the roller forming a nip portion with the heating rotating member, the elastic portion being elastically deformed in a region where the nip portion is formed, wherein the recording material on which the toner image is formed is conveyed while being heated in the nip portion, whereby the toner image is fixed on the recording material, and an annular conductive member provided in a longitudinal end portion of the metal core, the conductive member being in contact with the exposed portion of the heating rotating member while elastically deformed, wherein in a state where the roller is not mounted to the fixing device, an outer diameter of the conductive member is smaller than an outer diameter of the elastic portion of the roller.

Further features of the present disclosure will become apparent from the following description of exemplary embodiments with reference to the attached drawings.

DESCRIPTION OF THE EMBODIMENTS

[Image Forming Apparatus]

Figure 7:
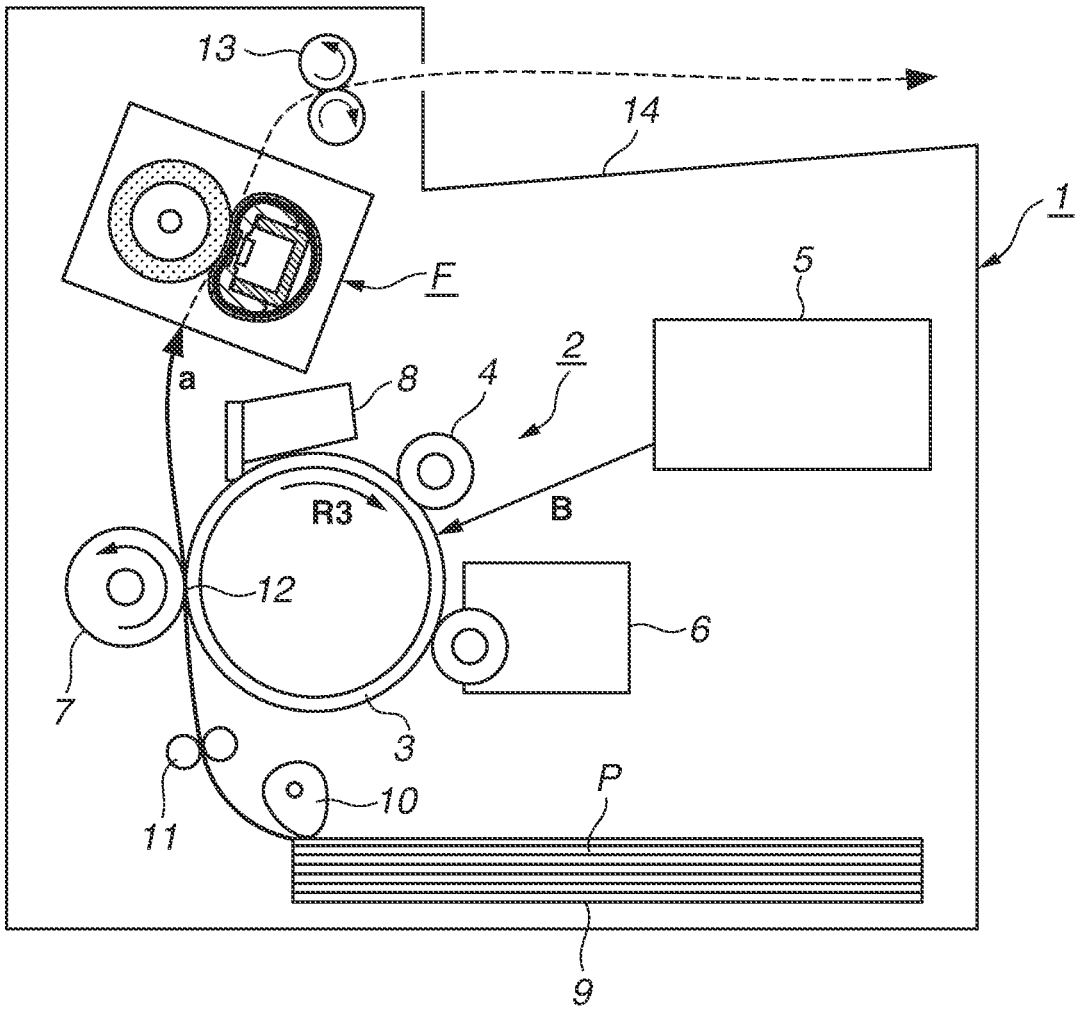
FIG. 7 is a schematic diagram illustrating a configuration of an example of an image forming apparatus.

A first exemplary embodiment is described. FIG. 7 is a schematic diagram illustrating the configuration of an example of an image forming apparatus 1, in which an image heating device according to the present disclosure is provided as a fixing device F. The image forming apparatus 1 is a monochrome laser printer using an electrophotographic recording technique.

In the image forming apparatus 1, an image forming unit 2, which forms a toner image on a recording material (hereinafter referred to as "sheet") P, includes a drum-type electrophotographic photosensitive member (hereinafter referred to as "drum") 3 as an image bearing member driven to rotate in the direction of an arrow R3. Further, the image forming unit 2 includes, as electrophotographic process devices for acting on the drum 3 and disposed in order around the drum 3 along the rotational direction of the drum 3, a charging device 4, a laser scanner 5, a developing device 6, a transfer roller 7, and a drum cleaner 8. The laser scanner 5 is an exposure device for irradiating the drum 3 with laser light B.

The principle and operation of the formation of an electrophotographic image using a toner image on the drum 3 by the image forming unit 2 are known, and therefore are not described here.

One of sheets P stacked and stored in a cassette 9 is separated and fed by a sheet feeding roller 10, which is driven at predetermined control timing. Then, the sheet P is conveyed by a conveying roller 11 to a transfer nip portion 12, which is a contact portion between the drum 3 and the transfer roller 7. The sheet P onto which a toner image has been transferred from the drum 3 side in the transfer nip portion 12 is conveyed to the fixing device F, and the toner image is heated and fixed. The sheet P which has exited from the fixing device F and on which an image has been formed is discharged to a discharge tray 14 by conveying rollers 13. "a" indicates a sheet conveying direction (a recording material conveying direction).

[Fixing Device]

In the fixing device F in the following description, a "front side" refers to the entrance side of the sheet P, and a "back side" refers to the exit side of the sheet P. "Left" or "right" refers to the left or the right of the device F as viewed from the front side. In the present exemplary embodiment, the right side is defined as one end side (a driving side), and the left side is defined as the other end side (a non-driving side). An "upstream side" and a "downstream side" refer to the upstream side and the downstream side, respectively, in the sheet conveying direction a. Further, the axial direction of a pressure roller or a direction parallel to the axial direction of the pressure roller is defined as a longitudinal direction, and a direction orthogonal to the longitudinal direction is defined as a short direction.

Figure 2:
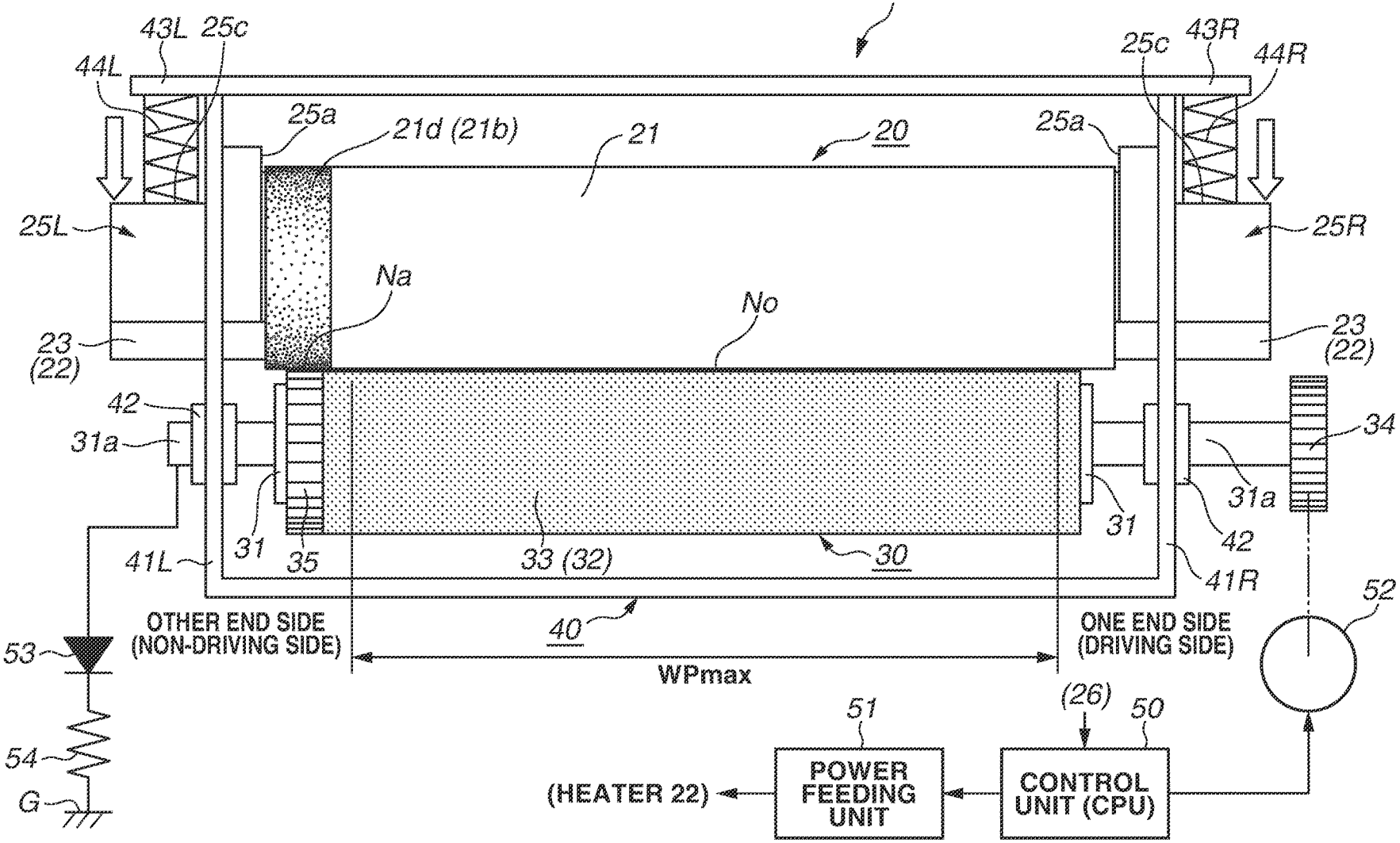
FIG. 2 is a front schematic diagram of the fixing device according to the first exemplary embodiment.
Figure 3:
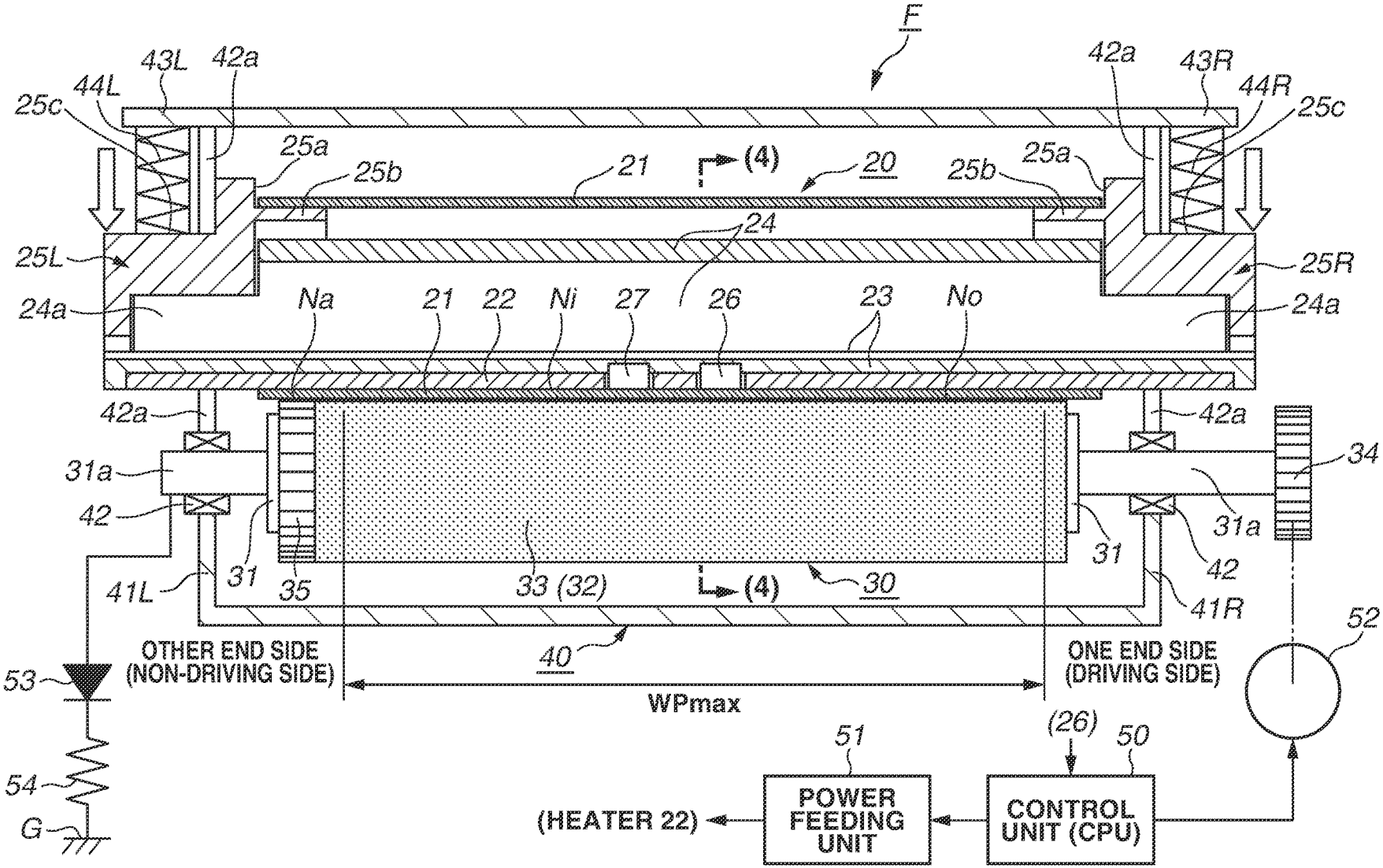
FIG. 3 is a cutaway front schematic diagram of the fixing device.
Figure 4:
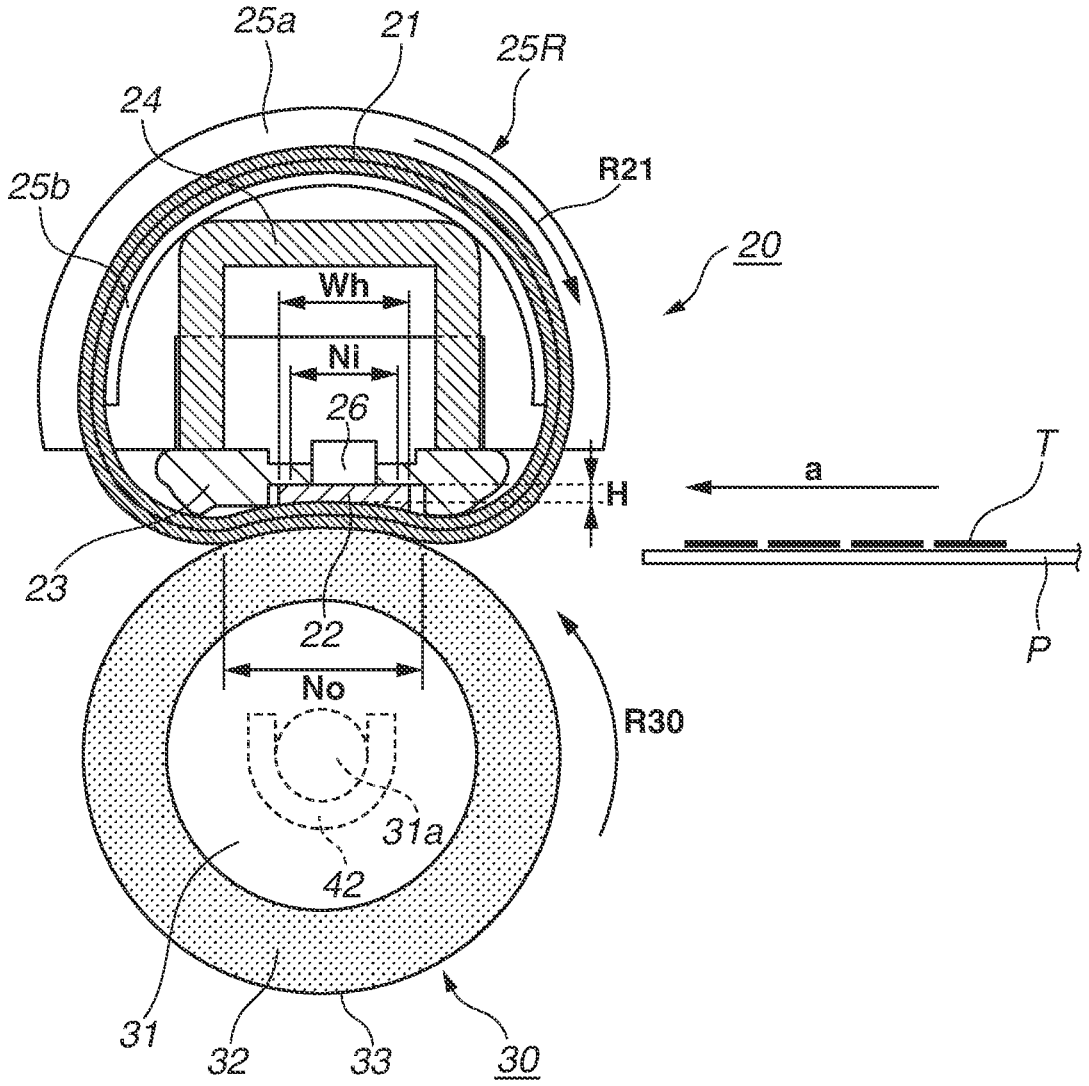
FIG. 4 is an enlarged schematic cross-sectional view along a line (4)-(4) in a direction of arrows in FIG. 3.

The fixing device F according to the present exemplary embodiment is an image heating device (an on-demand fixing device (ODF)) using a film (belt) heating method for the purpose of shortening the start-up time and achieving low power consumption. FIG. 2 is a front schematic diagram of the fixing device F according to the present exemplary embodiment. FIG. 3 is a cutaway front schematic diagram of the fixing device F. FIG. 4 is an enlarged schematic cross-sectional view along a line (4)-(4) in the direction of arrows in FIG. 3.

The fixing device F mainly includes a film unit (belt unit) 20, a pressure roller 30 serving as a driving rotating member having elasticity, and a device frame member (chassis or housing) 40, which accommodates the film unit 20 and the pressure roller 30.

The film unit 20 includes a fixing film (hereinafter referred to as "film") 21, which is an endless (cylindrical) rotatable belt having flexibility and loosely externally fit to internal assemblies (internal members). Within the film 21, a heating heater (hereinafter referred to as "heater") 22 as a heating body, a heater holder (hereinafter referred to as "holder") 23 as a holding member for holding the heater 22, and a stay 24, which supports the holder 23, are disposed as the internal assemblies.

Figure 5A:
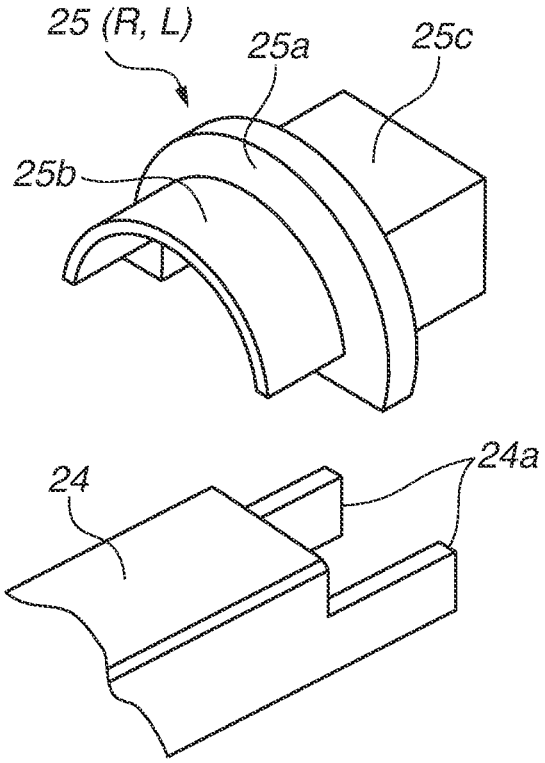
FIGS. 5A and 5B are external perspective schematic diagrams each illustrating a flange member and an outward protruding portion of a stay to which the flange member is fit.
Figure 5B:
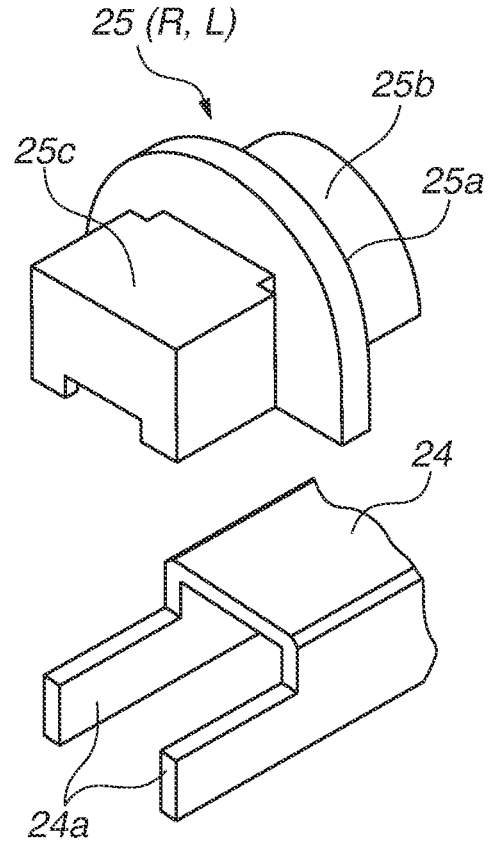

Each of the heater 22, the holder 23, and the stay 24 is a member having a length longer than the width (length) of the film 21, and one end side and the other end side of each member protrude outward from both end portions of the film 21. Then, flange members 25R and 25L on one end side and the other end side are fit to outward protruding portions 24*a* on one end side and the other end side, respectively, of the stay 24. The flange members 25R and 25L are molded products made of a heat-resistant resin and shaped symmetrically to each other. FIGS. 5A and 5B are external perspective schematic diagrams each illustrating the flange member 25 (R, L) according to the present exemplary embodiment and the outward protruding portion 24*a* of the stay 24 to which the flange member 25 (R, L) is fit.

The film 21 is loosely externally fit to the outside of the internal assemblies 22 to 24 such that the movement of the film 21 in the width direction is restricted by opposed flange surfaces (flange bases) 25*a* and 25*a* of the flange members 25R and 25L, which are fit to both end portions of the stay 24. Further, the rotation of the film 21 is guided by the inner surfaces of both end portions of the film 21 coming into contact with arcuate guide portions 25*b*, which are provided on the flange surfaces 25*a* of the flange members 25R and 25L.

(1) Film

Figure 6:
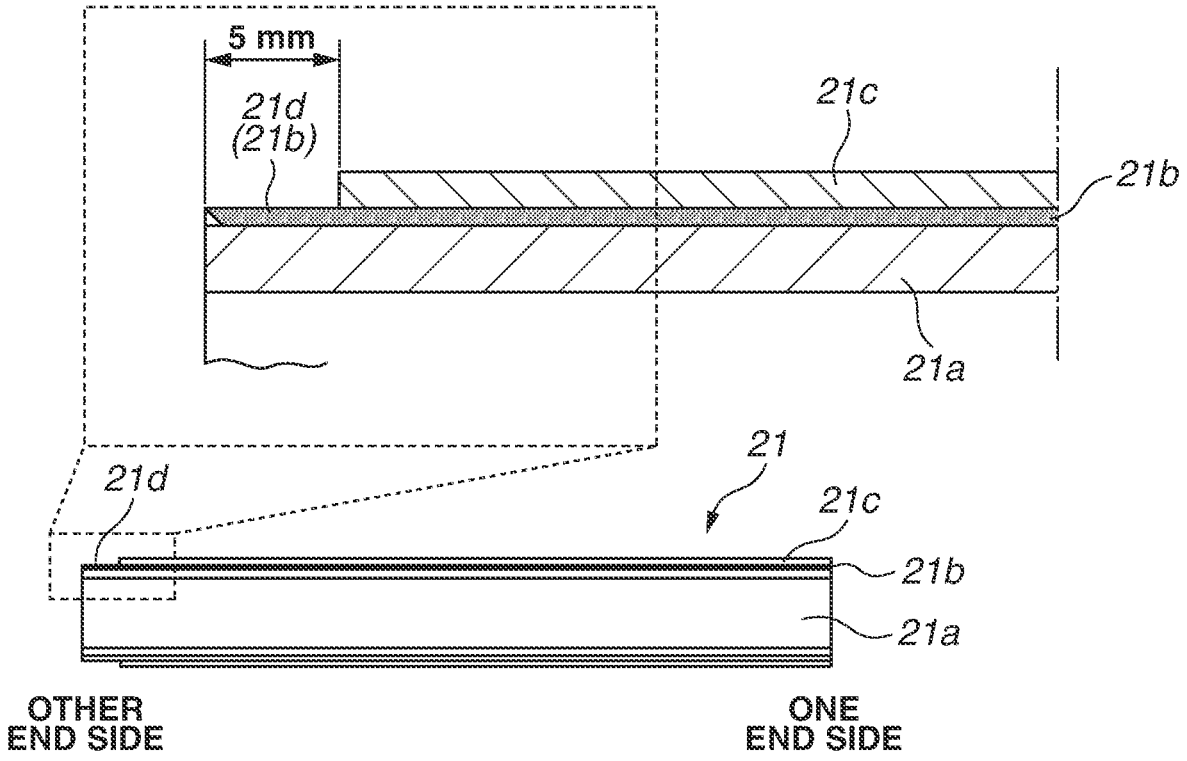
FIG. 6 is a diagram illustrating a layer configuration of a film.

The film 21 according to the present exemplary embodiment, which has flexibility, is almost cylindrical (tubular) due to the elasticity of the film 21 itself in a free state (the state where the film 21 is not attached to the device F). Then, the film 21 has an outer diameter of 20 mm and has a multi-layered configuration in the thickness direction. FIG. 6 is a schematic diagram illustrating the layer configuration of the film 21. As the layer configuration, the film 21 includes a cylindrical base layer 21*a*, which maintains the strength of the film 21, a conductive primer layer 21*b*, which is disposed on the outer circumferential surface of the base layer 21*a*, and a release layer 21*c*, which is further disposed outside the conductive primer layer 21*b* and reduces the attachment of dirt to the surface of the film 21.

The material of the base layer 21*a* requires heat resistance because the base layer 21*a* receives heat from the heater 22, and also requires strength because the base layer 21*a* slides in contact with the heater 22. Thus, a metal such as stainless used steel (SUS: stainless steel) or nickel, or a heat-resistant resin such as polyimide may be used. A metal is stronger than a resin and therefore allows the base layer 21*a* to be thinned. Further, a metal also has high thermal conductivity and therefore facilitates the transmission of heat from the heater 22 to the surface of the film 21. On the other hand, a resin has a smaller specific gravity than a metal and therefore has the advantage of easily warming up due to small heat capacity. Further, a resin can be used to mold a thin film by coating molding, and therefore, the base layer 21*a* can be molded inexpensively.

In the present exemplary embodiment, a polyimide resin is used as the material of the base layer 21*a* of the film 21 and used by adding a carbon filler to the polyimide resin to improve the thermal conductivity and the strength. The smaller the thickness of the base layer 21*a*, the more easily heat from the heater 22 is transmitted to the surface of the film 21. In this case, however, the strength of the base layer 21*a* decreases. Thus, it is desirable that the thickness of the base layer 21*a* should be about 15 μm to 100 μm. In the present exemplary embodiment, the thickness of the base layer 21*a* is 50 μm.

The conductive primer layer 21*b* serving as a conductive layer is made of a polyimide resin or a fluororesin, and carbon is added to the resin, thereby achieving low resistance. When a sheet is passed through the fixing device F, a conductive layer exposed portion 21*d*, which is an exposed portion of the conductive primer layer 21*b* and is disposed annularly on one end side of the film 21, is connected to the ground (the earth) via an annular conductive rubber ring 35, which is a conductive elastic body (a conductive member) disposed on the pressure roller 30 side. This stabilizes the potential of the film 21. This will be described below.

It is desirable that as the material of the release layer 21*c*, a fluororesin such as a perfluoroalkoxy resin (PFA), a polytetrafluoroethylene resin (PTFE), or a tetrafluoroethylene-hexafluoropropylene resin (FEP) should be used. In the present exemplary embodiment, among fluororesins, PFA, which has excellent release properties and heat resistance, is used, and a conductive material is dispersed in the PFA, thereby achieving medium resistance.

The release layer 21*c* may be obtained by covering a tube, or may be obtained by coating a surface with a coating material. In the present exemplary embodiment, the release layer 21*c* is molded by coating excellent in thin molding. The thinner the release layer 21*c*, the more easily heat from the heater 22 is transmitted to the surface of the film 21. If, however, the release layer 21*c* is too thin, the durability of the release layer 21*c* decreases. Thus, it is desirable that the thickness of the release layer 21*c* should be about 5 μm to 30 μm. In the present exemplary embodiment, the thickness of the release layer 21*c* is 10 μm.

To bring the conductive rubber ring 35 into contact with the conductive primer layer 21*b* to obtain conduction, in a longitudinal end portion having a width of 5 mm on the other end side of the film 21, the release layer 21*c* is not molded, and the conductive layer exposed portion 21*d* is formed, in which part of the conductive primer layer 21*b* is exposed in the circumferential direction (annularly) of the film 21.

(2) Heater

As the heater 22 according to the present exemplary embodiment, a general heater which is used in a heating device using a film heating method and in which a resistance heating element is provided in series on a substrate made of ceramics is employed. As the heater 22, a heater obtained by coating the surface of an alumina substrate having a width Wh (FIG. 4) of 6 mm in the sheet conveying direction a and a thickness H of 1 mm by screen printing with a resistance heating element made of silver-palladium (Ag/Pd) and having a thickness of 10 μm, and covering the resistance heating element with glass having a thickness of 50 μm as a heating element protection layer is used.

The heater 22 receives the supply of power via an electrical connector (not illustrated) from a power feeding unit 51, which is controlled by a control unit (control circuit unit: central processing unit (CPU)) 50, and a predetermined effective entire length region of the resistance heating element rapidly generates heat. On the back surface of the heater 22, a thermistor 26 is placed, which is a temperature detection element for detecting the temperature of the ceramic substrate. A detection signal regarding the temperature of the thermistor 26 is input to the control unit 50. According to this input signal from the thermistor 26, the control unit 50 appropriately controls a current to be applied from the power feeding unit 51 to the resistance heating element of the heater 22, thereby raising the temperature of the heater 22 to a predetermined temperature and adjusting the temperature so that the predetermined temperature is maintained.

Further, on the back surface of the heater 22, a thermal fuse 27 is placed, which is a safety element for disconnecting a power feeding circuit from the power feeding unit 51 to the heater 22 in a case where the heater 22 produces abnormal heat. The heater 22 is connected to mains electricity via the thermal fuse 27. If the heater 22 reaches an abnormally high temperature, the thermal fuse 27 performs an off operation to disconnect the feeding of power from the mains electricity to the heater 22.

(3) Holder and Stay

It is desirable that the holder 23 should be made of a material having low heat capacity so that it is difficult for the holder 23 to draw heat from the heater 22. In the present exemplary embodiment, a liquid-crystal polymer (LCP), which is a heat-resistant resin, is used. The holder 23 is supported by the stay 24, which is made of iron, from the opposite side of the heater 22 so that the holder 23 has strength.

(4) Pressure Roller

The pressure roller 30 according to the present exemplary embodiment is an elastic roller including a metal core 31 and an elastic layer 32, which is formed in a roller manner around the outer circumference of (outside) the metal core 31. The pressure roller 30 according to the present exemplary embodiment has an outer diameter of 14 mm. The elastic layer 32 is formed by concentrically disposing silicone rubber having a thickness of 2.5 mm in a roller manner on a portion having an outer diameter of 9 mm in the metal core 31, which is made of iron. As the elastic layer 32, silicone rubber or fluoro-rubber, which has heat resistance, is used. In the present exemplary embodiment, silicone rubber is used. The elastic layer 32 of the pressure roller 30 according to the present exemplary embodiment is an elastic layer made of solid rubber.

The outer diameter of the pressure roller 30 is about 10 to 50 mm. The smaller the outer diameter, the more reduced the heat capacity. If, however, the outer diameter is too small, the width in the sheet conveying direction a of a fixing nip portion No, which is formed between the film 21 and the pressure roller 30 by pressure contact with the film unit 20, becomes narrow. Thus, the outer diameter of the pressure roller 30 requires a moderate diameter. In the present exemplary embodiment, the outer diameter of the pressure roller 30 is 14 mm. Also the thickness of the elastic layer 32 requires a moderate thickness because if the thickness is too small, heat escapes to the metal core 31, which is made of a metal. Thus, in the present exemplary embodiment, the thickness of the elastic layer 32 is 2.5 mm.

On the elastic layer 32, a release layer 33, which is made of a perfluoroalkoxy resin (PFA), is formed as a toner release layer. Similarly to the release layer 21*c* of the film 21, the release layer 33 may be obtained by covering a tube or coating a surface with a coating material. In the present exemplary embodiment, the release layer 33 has a layer thickness of 20 μm using a tube having excellent durability. As the material of the release layer 33, a fluororesin such as PTFE or FEP, or fluoro-rubber or silicone rubber, which has excellent release properties, may be used instead of PFA. To distinguish from portions of the metal core 31 exposed in longitudinal end portions of the pressure roller 30, a portion of the elastic layer 32 and the release layer 33 of the pressure roller 30 is defined as an elastic portion.

The lower the surface hardness of the pressure roller 30, the lower pressure the width of the fixing nip portion No can be obtained at. If, however, the surface hardness is too low, the durability of the pressure roller 30 decreases. Thus, in the present exemplary embodiment, the surface hardness of the pressure roller 30 is 40° according to Asker C hardness (with a load of 600 g).

In both end portions of the metal core 31 of the pressure roller 30, shaft portions 31*a* having smaller diameters than that of the metal core 31 are disposed concentrically with the metal core 31. The pressure roller 30 is rotatably disposed by bearing the shaft portions 31*a* and 31*a* on one end side and the other end side through bearing members 42 between side plates 41R and 41L on one end side and the other end side, respectively, of the device frame member 40. Further, in the shaft portion 31*a* on one end side, a driving gear 34 is disposed concentrically with the shaft portion 31*a*.

The driving force of a motor 52, which is controlled by the control unit 50, is transmitted to the gear 34 through a drive transmission portion (not illustrated), whereby the pressure roller 30 is driven to rotate as a driving rotating member in the direction of an arrow R30 in FIG. 4 at a predetermined circumferential speed. In the present exemplary embodiment, the pressure roller 30 is driven to rotate at a surface moving speed of 150 mm/sec.

(5) Pressurization Mechanism

The film unit 20 is arranged parallel to the pressure roller 30 such that the heater 22 side is opposed to the pressure roller 30, which is disposed rotatably relative to the device frame member 40 as described above. The flange members 25R and 25L on one end side and the other end side of the film unit 20 are engaged with guide slit portions 42*a* and 42*a*, which are formed in the side plates 41R and 41L, respectively, of the device frame member 40.

The guide slit portions 42*a* and 42*a* guide the flange members 25R and 25L, respectively, in a sliding manner in a direction toward the pressure roller 30 and a direction away from the pressure roller 30. Thus, the film unit 20 has a degree of freedom where the entirety of the film unit 20 can move in a direction toward the pressure roller 30 and a direction away from the pressure roller 30 along the guide slit portions 42*a* and 42*a* between the side plates 41R and 41L.

Then, a pressure spring 44R is provided in a contracted manner between a spring reception portion 25*c* in the flange member 25R on one end side and a spring reception portion 43R on one end side of the device frame member 40. Similarly, a pressure spring 44L is provided in a contracted manner between a spring reception portion 25*c* in the flange member 25L on the other end side and a spring reception portion 43L on the other end side of the device frame member 40.

By the reaction forces of the pressure springs 44R and 44L due to their provision in a contracted manner, predetermined equivalent pressing forces act on the outward protruding portions 24*a* on one end side and the other end side of the stay 24 of the film unit 20 through the flange members 25R and 25L, respectively. Consequently, the holder 23 having the heater 22 and the pressure roller 30 come into pressure contact with each other with a predetermined pressure force across the film 21 against the elasticity of the elastic layer 32 of the pressure roller 30. In the fixing device F according to the present exemplary embodiment, the heater 22 or the heater 22 and the holder 23 function as a backup member for coming into contact with the inner surface of the film 21.

Thus, as illustrated in FIG. 4, the fixing nip portion No having a predetermined width in the sheet conveying direction a is formed between the film 21 and the pressure roller 30. Further, the heater 22 comes into contact with the inner surface of the film 21, forms an inner surface nip portion Ni having a predetermined width in the sheet conveying direction a, and heats the film 21 from within.

(6) Fixing Operation

As described above, the driving force of the motor 52, which is controlled by the control unit 50, is transmitted to the gear 34 of the pressure roller 30 through the drive transmission portion, whereby the pressure roller 30 is driven to rotate as a driving rotating member in the direction of the arrow R30 in FIG. 4 at the predetermined circumferential speed. By the rotation of the pressure roller 30, a rotational force acts on the film 21 by the frictional force between the film 21 and the pressure roller 30 in the fixing nip portion No. Consequently, the film 21 is driven to rotate in the direction of an arrow R21 at a circumferential speed almost corresponding to the circumferential speed of the rotation of the pressure roller 30, while the inner surface of the film 21 slides in close contact with the surface of the heater 22 in the inner surface nip portion Ni.

Meanwhile, the heater 22 receives the supply of power from the power feeding unit 51, which is controlled by the control unit 50, and the heater 22 rapidly generates heat. The temperature of the heater 22 is detected by the thermistor 26, and detected temperature information is input to the control unit 50. According to the input detected temperature information, the control unit 50 appropriately controls a current to be applied from the power feeding unit 51 to the heater 22, thereby raising the temperature of the heater 22 to a predetermined temperature and adjusting the temperature so that the predetermined temperature is maintained.

As described above, the pressure roller 30 is driven to rotate, the film 21 is driven to rotate according to the rotation of the pressure roller 30, and the heater 22 is raised to the predetermined temperature to adjust the temperature. In this state, a sheet P, which bears an unfixed toner image T, is introduced from the transfer nip portion 12 side into the fixing nip portion No. The sheet P is introduced into the fixing nip portion No such that the surface of the sheet P on which the toner image T is borne faces the film 21. Then, the sheet P is nipped and conveyed. Consequently, the unfixed toner image T on the sheet P is heated and pressurized, and is fixed as a fixedly attached image. The sheet P having passed through the fixing nip portion No self-strips from the surface of the film 21, and is discharged and conveyed from the fixing device F.

In the image forming apparatus 1 and the fixing device F according to the present exemplary embodiment, each sheet P in various width sizes is conveyed based on so-called center reference, in which the center of the width of the sheet is used as a reference. The device may be configured such that the sheet P is conveyed based on so-called one-side reference, in which one end side in the width direction of the sheet is used as a reference. In FIGS. 2 and 3, WPmax represents the width of a region where a sheet of a maximum width size that can be used in the device F is passed.

(7) Configuration for Grounding Surface of Film

As described above, on the other end side of the film 21, the conductive layer exposed portion (conductive surface) 21*d*, which is an exposed portion of the conductive primer layer 21*b*, is disposed annularly in the circumferential direction of the film 21. On the pressure roller 30 side, in a portion located corresponding to the conductive layer exposed portion 21*d* of the film 21, the annular (ring-shaped or doughnut-shaped) conductive rubber ring 35 is disposed, which is a conductive elastic body (a conductive elastic member) that comes into contact with the conductive layer exposed portion 21*d*.

Then, the conductive layer exposed portion 21*d* on the film 21 side is grounded via the conductive rubber ring on the pressure roller 30 side. Consequently, particularly even when a dried sheet having high electrical resistance is passed, the charging of the surface of the film 21 due to the friction between the sheet P and the film 21 is suppressed, thereby stabilizing the potential of the film 21.

The fixing device according to the present exemplary embodiment is characterized in that to suppress the buckling of the film 21 due to the force of the film 21 acting in the width direction (the longitudinal direction), the outer diameter of the conductive rubber ring 35 placed on the metal core 31 of the pressure roller 30 in the state where the pressure roller 30 is not attached to the fixing device F is smaller than the outer diameter of the elastic portion of the pressure roller 30.

Figure 1A:
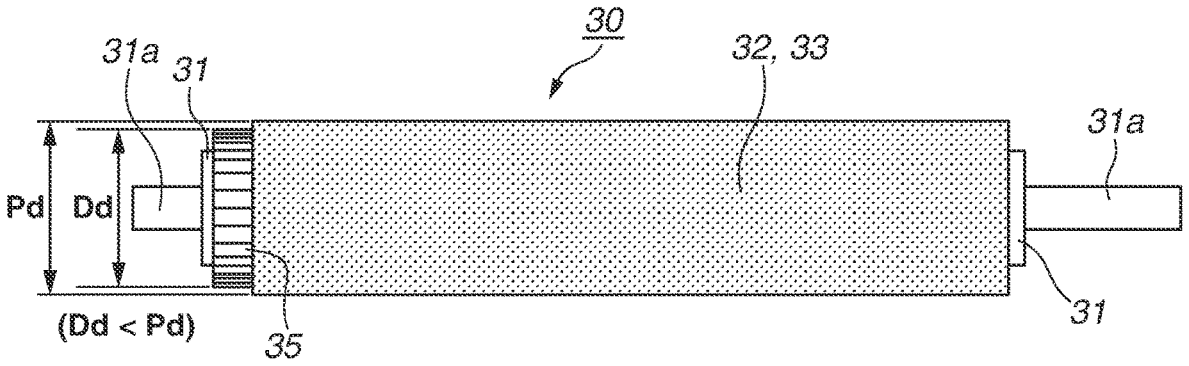
FIGS. 1A and 1B are diagrams illustrating configurations of a pressure roller and a conductive rubber ring of a fixing device according to a first exemplary embodiment.
Figure 1B:
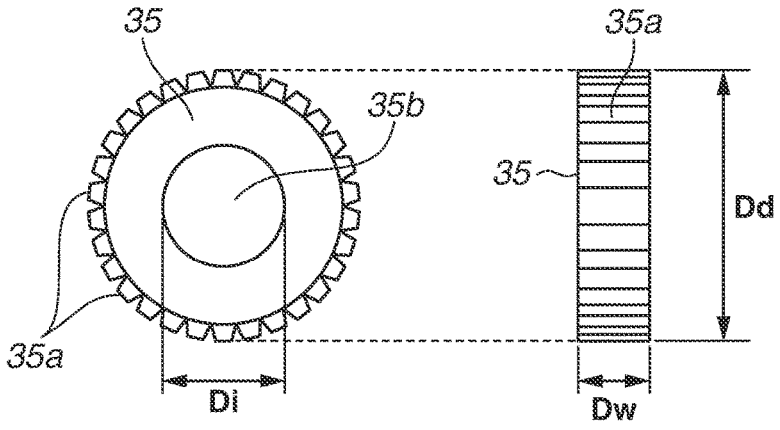

FIG. 1A is a front view of the pressure roller 30 according to the present exemplary embodiment, in which the conductive rubber ring 35 is placed on the metal core 31 of the pressure roller 30 in the state where the pressure roller 30 is not attached to the fixing device F. FIG. 1B is a schematic diagram illustrating the configuration of the conductive rubber ring 35 alone. In the pressure roller 30 alone not attached to the fixing device F, neither the conductive rubber ring 35 nor the elastic portion of the pressure roller 30 is elastically deformed.

In the free state of the pressure roller 30 (an unloaded state or the state where the pressure roller 30 is not attached to the fixing device F), an outer diameter Pd of the pressure roller 30 according to the present exemplary embodiment is 14 mm. On the other end side of the metal core 31 of the pressure roller 30, the conductive rubber ring 35 is fit as a conductive elastic body to a portion having an outer diameter of 8 mm in the metal core 31. The conductive rubber ring 35 is made of solid conductive silicone rubber of which the resistance is adjusted by mixing silicone rubber with carbon black. The hardness of the conductive elastic member is about 20° to 30° (JIS-A). In the present exemplary embodiment, the hardness of the conductive elastic member is 23°.

On the outer circumferential surface of the cylinder of the conductive rubber ring 35, a knurling shape (uneven shape) 35*a* is formed to suppress defective conduction with the conductive layer exposed portion 21*d* of the film 21 due to dirt such as toner. Further, in the free state of the conductive rubber ring 35, an outer diameter Dd of the conductive rubber ring 35 is 13.8 mm, which is smaller than the outer diameter Pd of the pressure roller 30, namely 14 mm. A diameter (inner diameter) Di of an inner hole portion 35*b* is 6.5 mm, and a width Dw of the conductive rubber ring 35 is 3 mm.

The conductive rubber ring 35 is placed on a portion having an outer diameter of 8 mm in the metal core 31 of the pressure roller 30 and is attached with an interference of 1.5 mm. Consequently, conduction with the metal core 31 is secured, and also the conductive rubber ring 35 is fixed to rotate with the rotation of the metal core 31 without being shifted. That is, the conductive rubber ring 35 can rotate together with the metal core 31.

As described above, a pressurization mechanism pressurizes the film unit 20 against the pressure roller 30, and the film 21 and the pressure roller 30 form the fixing nip portion No. At this time, at a position opposed to the conductive layer exposed portion 21*d* of the film 21, the conductive rubber ring 35 also compressively deforms against its elasticity and forms a nip (hereinafter referred to as "conductive nip portion") Na (FIGS. 2 and 3) between the conductive layer exposed portion 21*d* and the conductive rubber ring 35.

The elasticity of the conductive rubber ring 35 compressed in the conductive nip portion Na brings the conductive layer exposed portion 21*d* and the conductive rubber ring 35 into contact with each other with certain stress, and electrical conduction is secured between the conductive layer exposed portion 21*d* and the conductive rubber ring 35. Further, the conductive rubber ring 35 is electrically connected to the ground G via the pressure roller metal core 31, which is made of a metal, a diode (rectifier) 53, and a safety resistor 54.

Toner used in the present exemplary embodiment is toner capable of being negatively charged. If the surface of the film 21 is positively charged, electrostatic offset is likely to occur due to an electrostatic force. In response, the diode 53 is placed, which has a rectifying action for releasing an electric charge having a polarity opposite to the charge polarity of toner from the surface of the film 21. As described above, the film 21 is connected to the ground G via the conductive layer exposed portion 21*d*, the conductive rubber ring 35, the metal core 31, the diode 53, and the resistor 54, thereby preventing electric charges having a polarity opposite to the charge polarity of toner from being accumulated.

It is known that if the above conduction cannot be obtained, and when sheets P left under a low temperature and low humidity environment and having high resistance are successively passed, electric charges accumulated in the film 21 cannot be removed, and electrostatic offset starts to occur.

Figure 8A:
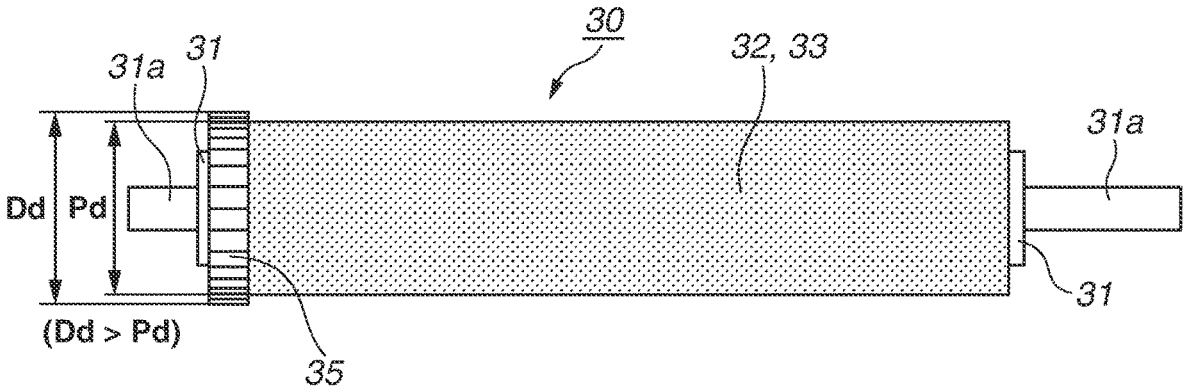
FIGS. 8A and 8B are diagrams illustrating a reference example.
Figure 8B:
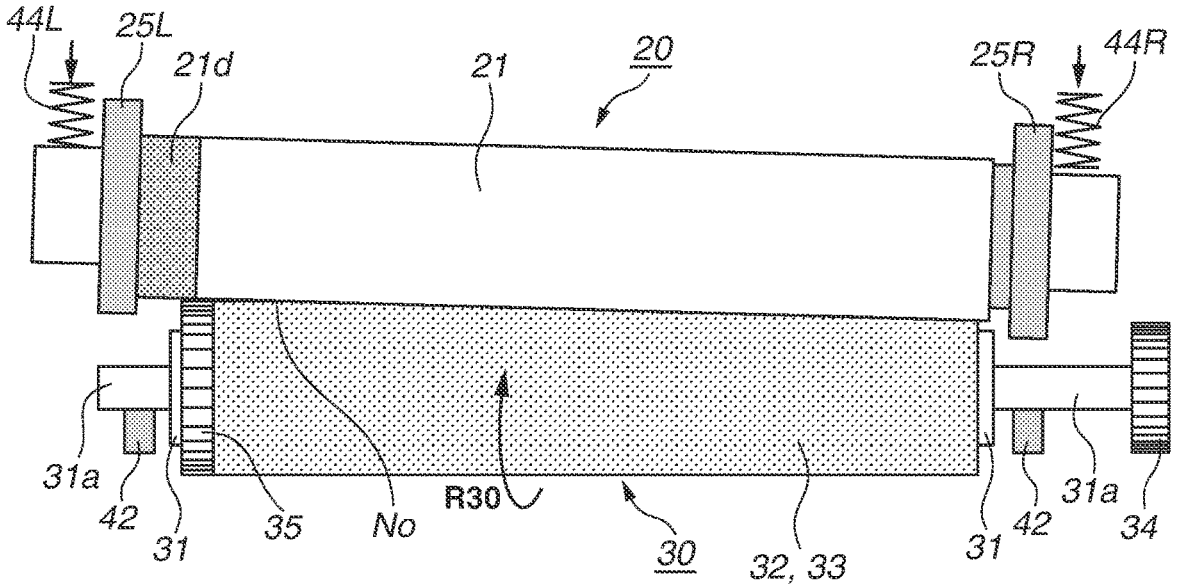

FIG. 8A illustrates as a reference example a case where the outer diameter Dd of the conductive rubber ring 35 is larger than the outer diameter Pd of the pressure roller 30. In the case of this pressure roller 30, as exaggeratedly illustrated in a device schematic diagram in FIG. 8B, the conductive rubber ring 35 of which the outer diameter Dd is larger than the outer diameter Pd of the pressure roller 30 brings the film 21 of the film unit 20 into contact with the pressure roller 30 in the state where the film 21 is inclined.

Thus, the amount of crush of the pressure roller 30 differs in the longitudinal direction of the elastic layer 32. Thus, a difference in outer diameter occurs in the longitudinal direction of the pressure roller 30. Consequently, the film feeding speed by the rotation of the pressure roller 30 is greater on the conductive rubber ring 35 side. That is, the speed of the film 21 differs in the longitudinal direction of the film 21, whereby the film 21 moves to the conductive rubber ring 35 side in the longitudinal direction and hits the flange surface (flange base) 25*a* of the flange member 25L on this side. The greater the difference in speed, the greater the force of the film 21 hitting the flange surface 25*a*.

In the present exemplary embodiment, as illustrated in FIG. 1, the outer diameter Dd of the conductive rubber ring 35 is smaller than the outer diameter Pd of the pressure roller 30. Thus, the inclination of the film 21 of the film unit 20 is suppressed relative to the pressure roller 30. Thus, the force of the film 21 hitting the flange surface 25*a* of the flange member 25L is small.

Figure 9A:
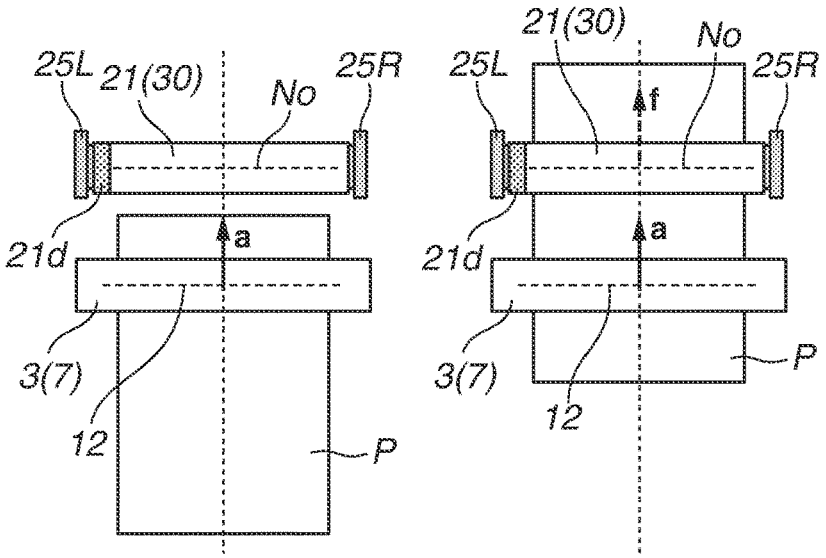
FIGS. 9A, 9B, and 9C are diagrams illustrating forces acting on the film by conveyance of a sheet.
Figure 9B:
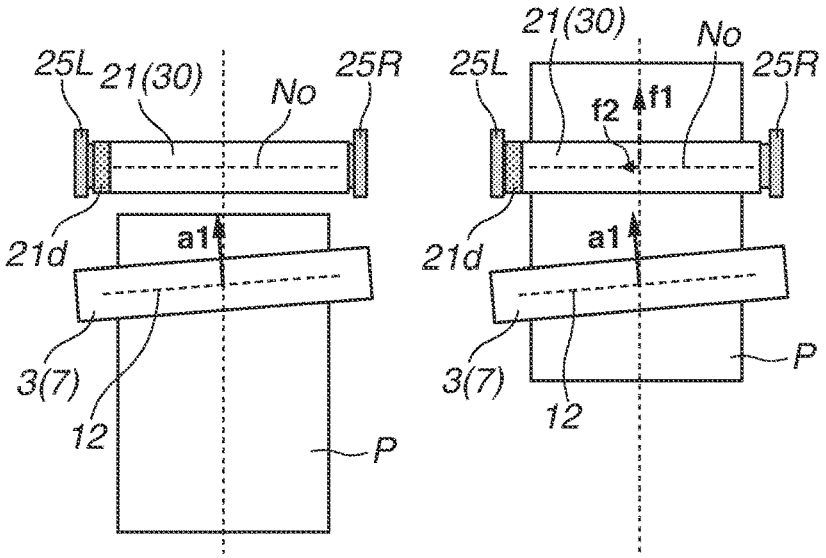
Figure 9C:
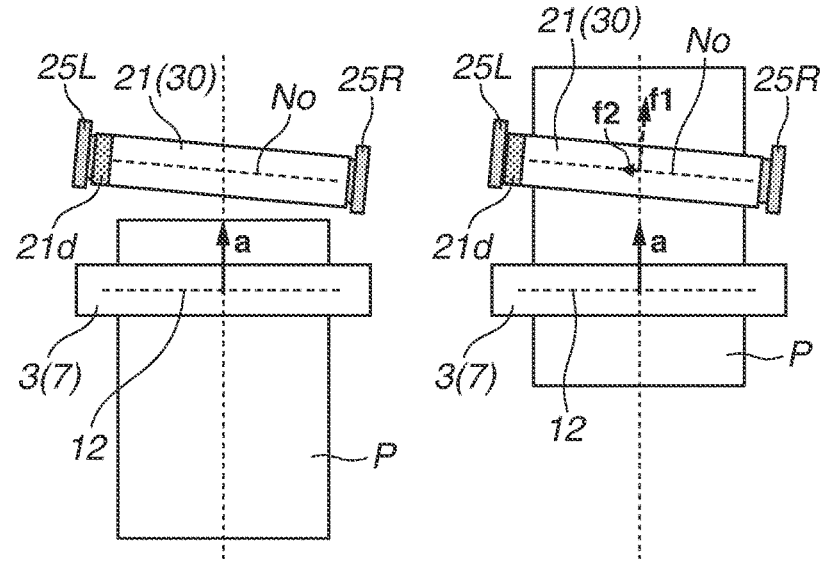

On the other hand, there is a case where a certain inclination occurs between the film 21 and the drum 3, which is an electrophotographic photosensitive member (an image bearing member), due to product tolerance. FIGS. 9A to 9C each illustrate the process in which the sheet P is nipped and conveyed by the transfer nip portion 12, which is formed by the drum 3 and the transfer roller 7, and is further nipped and conveyed by the fixing nip portion No of the fixing device F.

As illustrated in FIG. 9A, in a case where there is no inclination between the film 21 and the drum 3, the sheet P is conveyed by the transfer nip portion 12 in a straight direction indicated by an arrow a. Then, in the state where the sheet P is nipped by the transfer nip portion 12 and the fixing nip portion No, the film 21 receives a force in the direction of an arrow f from the sheet P. Thus, the force of the film 21 hitting the flange member 25 (R, L) does not occur.

As illustrated in FIG. 9B, however, in a case where the drum 3 is inclined relative to the film 21, the sheet P is conveyed by the transfer nip portion 12 in an oblique direction indicated by an arrow al. Then, in the state where the sheet P is nipped by the transfer nip portion 12 and the fixing nip portion No, the film 21 receives forces indicated by arrows f1 and f2 from the sheet P. Thus, the film 21 hits the flange member 25L by the force indicated by the arrow f2.

As illustrated in FIG. 9C, also in a case where the film 21 is inclined relative to the drum 3, and even if the sheet P is conveyed by the transfer nip portion 12 in the straight direction indicated by the arrow a, the film 21 receives forces in the directions of the arrows f1 and f2 from the sheet P. Thus, the film 21 hits the flange member 25L by the force indicated by the arrow f2.

In FIGS. 9B and 9C, the force of the film 21 hitting the flange member 25L is received from when the sheet P is nipped by both the transfer nip portion 12 and the fixing nip portion No to when the sheet P comes out of the transfer nip portion 12. Thus, if the distance between the transfer nip portion 12 and the fixing nip portion No is shortened by downsizing the device F, the distance to the position where the sheet P comes out of the transfer nip portion 12 increases, and the force of going to one side becomes great. In the present exemplary embodiment, the distance between the transfer nip portion 12 and the fixing nip portion No is 45 mm.

(Effects)

Regarding the first exemplary embodiment, variations 1 and 2 of the present exemplary embodiment, comparative examples 1 to 3, and the reference example (FIGS. 8A and 8B), electrostatic offset was evaluated, and the buckling (sheet passing durability) of the film 21 caused by the film 21 hitting the flange member 25 (R, L) was evaluated. Variations 1 and 2 of the present exemplary embodiment, comparative examples 1 to 3, and the reference example have conditions similar to those of the first exemplary embodiment, except for the outer diameter Dd of the conductive rubber ring 35.

1) Electrostatic offset was evaluated under a low temperature and low humidity (temperature: 15° C., humidity: 10%) environment. As an evaluation sheet, a sheet of Xerox Vitality Multipurpose Paper (letter size, 201b) left for two days under this low temperature and low humidity environment was used. As an evaluation image, a halftone image obtained by printing isolated single dots at 600 dpi, in which offset was likely to occur, in a portion from a position 5 mm away from the front end of the sheet to a position 20 mm away from the front end of the sheet was used.

Evaluations were made by successively performing printing on 100 sheets. A case where dirt did not occur due to offset toner on a solid white surface in a portion after the position 20 mm away from the front end of the sheet was indicated by "○". A case where dirt occurred due to offset toner on the solid white surface was indicated by "x".

2) The buckling of the film 21 was evaluated by, also taking into account the influence of the conveyance of the sheet P, using the image forming apparatus main body in the state where the drum 3 was inclined by 0.3 mm and the film 21 was inclined by −0.3 mm in both end portions in the longitudinal direction so that the film 21 went to the conductive rubber ring 35 side by conveyance.

Assuming the life of a product, the state of the film 21 was evaluated when 50,000 sheets of Xerox Vitality Multipurpose Paper (legal size, 201b) were passed. A case where buckling did not occur in the film 21 after the sheets were passed was indicated by "○". A case where buckling occurred in the film 21 after the sheets were passed was indicated by "x". The evaluation results are illustrated in table 1.

TABLE 1

| | Outer diameter Pd (mm) of pressure roller | Outer diameter Dd (mm) of conductive rubber ring | Electro-static offset | Sheet passing durability (buckling) |
|---|---|---|---|---|
| Comparative example 1 | 14 | 13.6 | x | ○ |
| Variation 1 of first exemplary embodiment | 14 | 13.7 | ○ | ○ |
| First exemplary embodiment | 14 | 13.8 | ○ | ○ |
| Variation 2 of first exemplary embodiment | 14 | 13.9 | ○ | ○ |
| Comparative example 2 | 14 | 14 | ○ | x |
| Comparative example 3 | 14 | 14.1 | ○ | x |
| Reference example | 14 | 14.2 | ○ | x |

As illustrated in table 1, the buckling (sheet passing durability) of the film 21 did not occur if the outer diameter Dd of the conductive rubber ring 35 was smaller than the outer diameter Pd of the pressure roller as indicated in the first exemplary embodiment, variations 1 and 2 of the present exemplary embodiment, and comparative example 1. This is because the inclination of the film 21 was suppressed relative to the pressure roller 30 by the conductive rubber ring 35, and the force of the film 21 hitting the flange member 25L was suppressed.

On the other hand, the evaluations of electrostatic offset were indicated by "x" in comparative example 1 and "○" in other cases. This is because in comparative example 1, the outer diameter Dd of the conductive rubber ring 35 was too small relative to the outer diameter Pd of the pressure roller 30, and therefore, the conductive rubber ring 35 could not come into contact with the conductive layer exposed portion 21*d* of the film 21. That is, the formation of the nip portion Na was failed, and the suppression of the charging of the film 21 was failed.

Based on the above, as in the first exemplary embodiment and variations 1 and 2 of the present exemplary embodiment, the outer diameter Dd of the conductive rubber ring 35 in the free state of the pressure roller 30 is made smaller than the outer diameter Pd of the pressure roller 30, and the outer diameter of the conductive rubber ring 35 is set to an outer diameter that allows the conductive rubber ring 35 to come into contact with the conductive layer exposed portion 21*d* of the film 21 when a sheet is passed. Consequently, it is possible to suppress the buckling of the film 21 and the occurrence of electrostatic offset.

In the first exemplary embodiment, evaluations were made based on a configuration in which the buckling of the film 21 is influenced by the conveyance of the sheet P. However, also in a configuration in which the force of the film 21 hitting the flange member 25 (R, L) occurs due to another cause, it is possible to suppress the buckling of the film 21 by carrying out the present exemplary embodiment.

In the present exemplary embodiment, the configuration is such that the film 21 is grounded via the conductive rubber ring 35 and the metal core 31. The effects of the present exemplary embodiment, however, are similar also in a configuration in which a voltage of the same polarity as the charge polarity of toner is applied to the conductive layer exposed portion 21*d* of the film 21 via the conductive rubber ring 35 and the metal core 31.

That is, the device can also be configured to include a power supply unit (not illustrated) for applying a voltage of the same polarity as the charge polarity of toner to the conductive layer exposed portion 21*d* of the film 21 via the metal core 31 and the conductive rubber ring 35.

A second exemplary embodiment of the present disclosure is described below. In the second exemplary embodiment, as the elastic layer 32 of the pressure roller 30, foamed silicone rubber is used to improve the thermal insulation effect with low heat capacity. That is, the elastic layer 32 is formed of a sponge-like elastic material including fine holes, such as a sponge rubber layer or a foamed rubber layer.

The specific gravity related to heat capacity of solid rubber is about 0.95 to 1.30, whereas the specific gravity related to heat capacity of foamed rubber is about 0.45 to 0.85. In the second exemplary embodiment, foamed rubber having a specific gravity of 0.45 was used. The above pressure roller 30 is used, whereby it is possible to shorten the time required to raise the surface temperature.

(Effects)

Similarly to the first exemplary embodiment, evaluations were made in the second exemplary embodiment, variations 3 to 5 of the second exemplary embodiment, the reference example (FIGS. 8A and 8B), and comparative examples 4 to 10. Variation 3 of the second exemplary embodiment, comparative examples 4, 5, 6, and 7, and the reference example have conditions similar to those of the second exemplary embodiment, except for the outer diameter Dd of the conductive rubber ring 35.

In variations 4 and 5 of the second exemplary embodiment and comparative examples 8, 9, and 10, the elastic layer 32 having a thickness of 3.5 mm was provided on a portion having a diameter of 13 mm in the metal core 31 such that the outer diameter of the pressure roller 30 was 20 mm. The inner diameter Di of the conductive rubber ring 35 was 10.5 mm, and the conductive rubber ring 35 was placed on a portion having a diameter of 12 mm in the metal core 31 such that the outer diameter Dd was different from that in the second exemplary embodiment. Other conditions were similar to those of the second exemplary embodiment. The evaluation results are illustrated in table 2.

TABLE 2

| | Outer diameter Pd (mm) of pressure roller | Outer diameter Dd (mm) of conductive rubber ring | Formula (1) | Electrostatic offset | Sheet passing durability (buckling) |
|---|---|---|---|---|---|
| Comparative example 4 | 14 | 13.6 | −0.029 | x | ○ |
| Variation 3 of second exemplary embodiment | 14 | 13.7 | −0.021 | ○ | ○ |
| Second exemplary embodiment | 14 | 13.8 | −0.014 | ○ | ○ |

TABLE 2-continued

| | Outer diameter Pd (mm) of pressure roller | Outer diameter Dd (mm) of conductive rubber ring | Formula (1) | Electrostatic offset | Sheet passing durability (buckling) |
|---|---|---|---|---|---|
| Comparative example 5 | 14 | 13.9 | −0.007 | ○ | x |
| Comparative example 6 | 14 | 14 | 0 | ○ | x |
| Comparative example 7 | 14 | 14.1 | 0.007 | ○ | x |
| Reference example | 14 | 14.2 | 0.014 | ○ | x |
| Comparative example 8 | 20 | 19.6 | −0.020 | x | ○ |
| Variation 4 of present exemplary embodiment | 20 | 19.7 | −0.015 | ○ | ○ |
| Variation 5 of second exemplary embodiment | 20 | 19.8 | −0.010 | ○ | ○ |
| Comparative example 9 | 20 | 19.9 | −0.005 | ○ | x |
| Comparative example 10 | 20 | 20 | 0 | ○ | x |

As illustrated in table 2, it is considered that the reason why the evaluations of electrostatic offset were indicated by "x" in comparative examples 4 and 8 is that while the sheet was passed, the conductive rubber ring 35 did not come into contact with the conductive layer exposed portion 21*d* of the film 21, and therefore, the suppression of the charging of the film 21 was failed.

The evaluations of the buckling (sheet passing durability) of the film 21 were indicated by "○" in examples where the following formula (1) was satisfied.

(Outer diameter of conductive rubber ring−outer diameter of pressure roller)/outer diameter of pressure roller≤−0.01 Formula (1):

That is, in the free state of the pressure roller 30, if the outer diameter of the conductive rubber ring 35 is Dd, and the outer diameter of the pressure roller 30 is Pd, the above formula (1) is as follows.

$$(Dd-Pd)/Pd \leq -0.01$$

At this time, in the free state of the pressure roller 30, the outer diameter Dd of the pressure roller 30 is the outer diameter of a center portion in the longitudinal direction of the pressure roller 30 (a center portion in the longitudinal direction of the rotating member).

When the pressure roller 30 according to the first exemplary embodiment including the elastic layer 32 made of solid rubber is pressurized and crushed, the rubber includes a compressed portion and a portion deforming to escape outward. Thus, the outer diameter of the pressure roller 30 is less likely to become small. In contrast, the pressure roller 30 according to the second exemplary embodiment including the elastic layer 32 made of foamed rubber deforms to crush air bubbles. Thus, the outer diameter of the pressure roller 30 becomes small. Thus, when the film 21 is inclined, a difference is more likely to occur in the speed of sending the film 21 in the longitudinal direction than in the case of solid rubber. The outer diameter was set to an outer diameter satisfying the above formula (1), whereby the further suppression of the inclination of the film 21 was succeeded. Thus, the suppression of the occurrence of the buckling of the film 21 was succeeded.

Based on the above, the outer diameter Dd of the conductive rubber ring 35 and the outer diameter Pd of the pressure roller 30 are set to outer diameters satisfying formula (1), and the outer diameter of the conductive rubber ring 35 is set to an outer diameter that allows the conductive rubber ring 35 to come into contact with the conductive layer exposed portion 21*d* of the film 21 when the sheet is passed. Consequently, it is possible to suppress the buckling of the film 21 and the occurrence of electrostatic offset.

In the above exemplary embodiment, the conductive layer exposed portion (conductive surface) 21*d* is placed on the other end side of the film 21. The present disclosure, however, is not limited to this. Alternatively, the conductive layer exposed portion 21*d* may be placed on one end side of the film 21. The conductive layer exposed portion 21*d* can be provided in at least part of the film 21 along the circumferential direction.

<Other Matters>

(1) The device can also be configured such that the pressurization configuration of the film unit 20 and the pressure roller 30 for forming the fixing nip portion No is such that the pressure roller 30 is pressurized against the film unit 20. The device can also be configured such that both the film unit 20 and the pressure roller 30 are pressurized against each other. That is, the pressurization mechanism only needs to be configured to pressurize at least one of the film unit 20 and the pressure roller 30 against the other.

(2) The device can also be configured such that in the film unit 20, the film 21 is stretched tightly around and supported by a plurality of suspension members, and the film 21 is rotated by the pressure roller 30 or a driving rotating member other than the pressure roller 30.

(3) The backup member of the film 21 may be a member other than the heater 22.

(4) A heating unit of the film 21 is not limited to the heater 22 according to the exemplary embodiment. An appropriate heating configuration such as an internal heating configuration, an external heating configuration, a contact heating configuration, or a non-contact heating configuration using another heating unit such as a halogen heater or an electromagnetic induction coil can be employed.

(5) In the exemplary embodiment, a description has been given using an example where the image heating device is a fixing device for heating and fixing an unfixed toner image formed on a recording material. The present disclosure, however, is not limited to this. The present disclosure can also be applied to a device (a glossiness improvement device) for reheating a toner image fixed or temporarily fixed to a recording material, thereby increasing the gloss (glossiness) of an image.

(6) The image forming apparatus is not limited to an image forming apparatus for forming a monocolor image as in the exemplary embodiment. Alternatively, the image forming apparatus may be an image forming apparatus for forming a color image. Further, the image forming apparatus can be implemented in various applications such as a copying machine, a fax, and a multifunction peripheral having a plurality of functions of these apparatuses by adding a necessary device, necessary equipment, and a necessary housing structure.

[Image Forming Apparatus]

Figure 15:
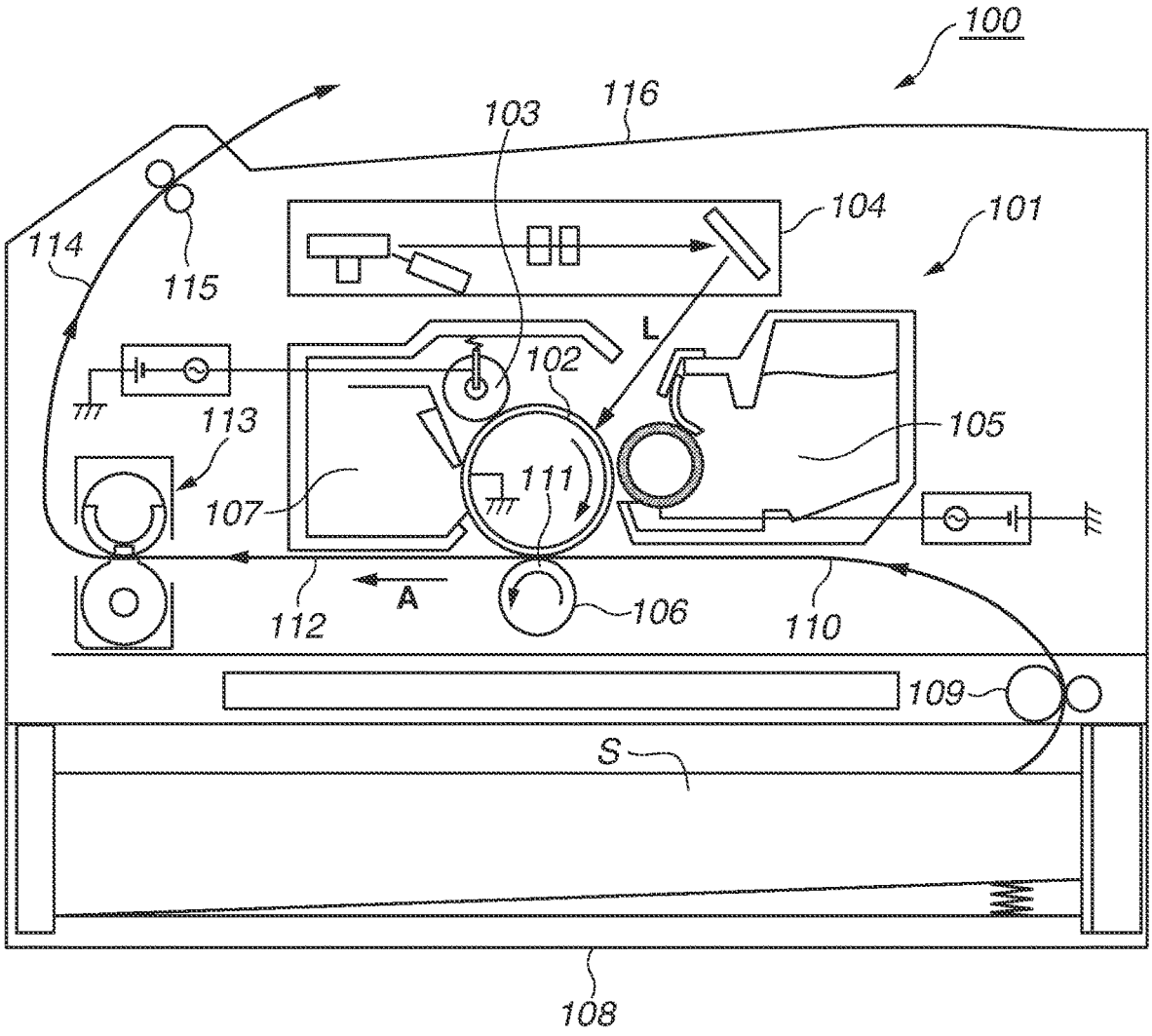
FIG. 15 is a schematic diagram illustrating a configuration of an example of an image forming apparatus.

A third exemplary embodiment is described. FIG. 15 is a schematic diagram illustrating the configuration of an example of an image forming apparatus 100, in which an image heating device according to the present disclosure is provided as a fixing device 113. The image forming apparatus 100 is a monochrome laser printer using an electrophotographic recording technique.

In the image forming apparatus 100, an image forming unit 101, which forms a toner image on a recording material (hereinafter referred to as "sheet") S, includes a drum-type electrophotographic photosensitive member (hereinafter referred to as "drum") 102 as an image bearing member driven to rotate in the direction of an arrow. Further, the image forming unit 101 includes, as electrophotographic process devices for acting on the drum 102 and disposed in order around the drum 102 along the rotational direction of the drum 102, a charging device 103, a laser scanner 104, a developing device 105, a transfer roller 106, and a drum cleaner 107. The laser scanner 104 is an exposure device for irradiating the drum 102 with laser light L.

The principle and operation of the formation of an electrophotographic image using a toner image on the drum 102 by the image forming unit 101 are known, and therefore are not described here.

One of sheets S stacked and stored in a cassette 108 is separated and fed by a sheet feeding roller 109, which is driven at predetermined control timing. Then, the sheet S is conveyed through a conveying path 110 to a transfer nip portion 111, which is a contact portion between the drum 102 and the transfer roller 106. The sheet S onto which a toner image has been transferred from the drum 102 side in the transfer nip portion 111 is conveyed through a conveying path 112 to the fixing device 113, and the toner image is heated and fixed. The sheet S which has exited from the fixing device 113 and on which an image has been formed is discharged through a conveying path 114 to a discharge tray 116 by conveying rollers 115. "A" indicates a sheet conveying direction (a recording material conveying direction).

[Fixing Device]

In the fixing device 113 in the following description, a "front side" refers to the entrance side of the sheet S, and a "back side" refers to the exit side of the sheet S. "Left" or "right" refers to the left or the right of the device 113 as viewed from the front side. In the present exemplary embodiment, the right side is defined as one end side (a driving side), and the left side is defined as the other end side (a non-driving side). An "upstream side" and a "downstream side" refer to the upstream side and the downstream side, respectively, in the sheet conveying direction A. Further, the axial direction of a pressure roller or a direction parallel to the axial direction of the pressure roller is defined as a longitudinal direction, and a direction orthogonal to the longitudinal direction is defined as a short direction.

Figure 11:
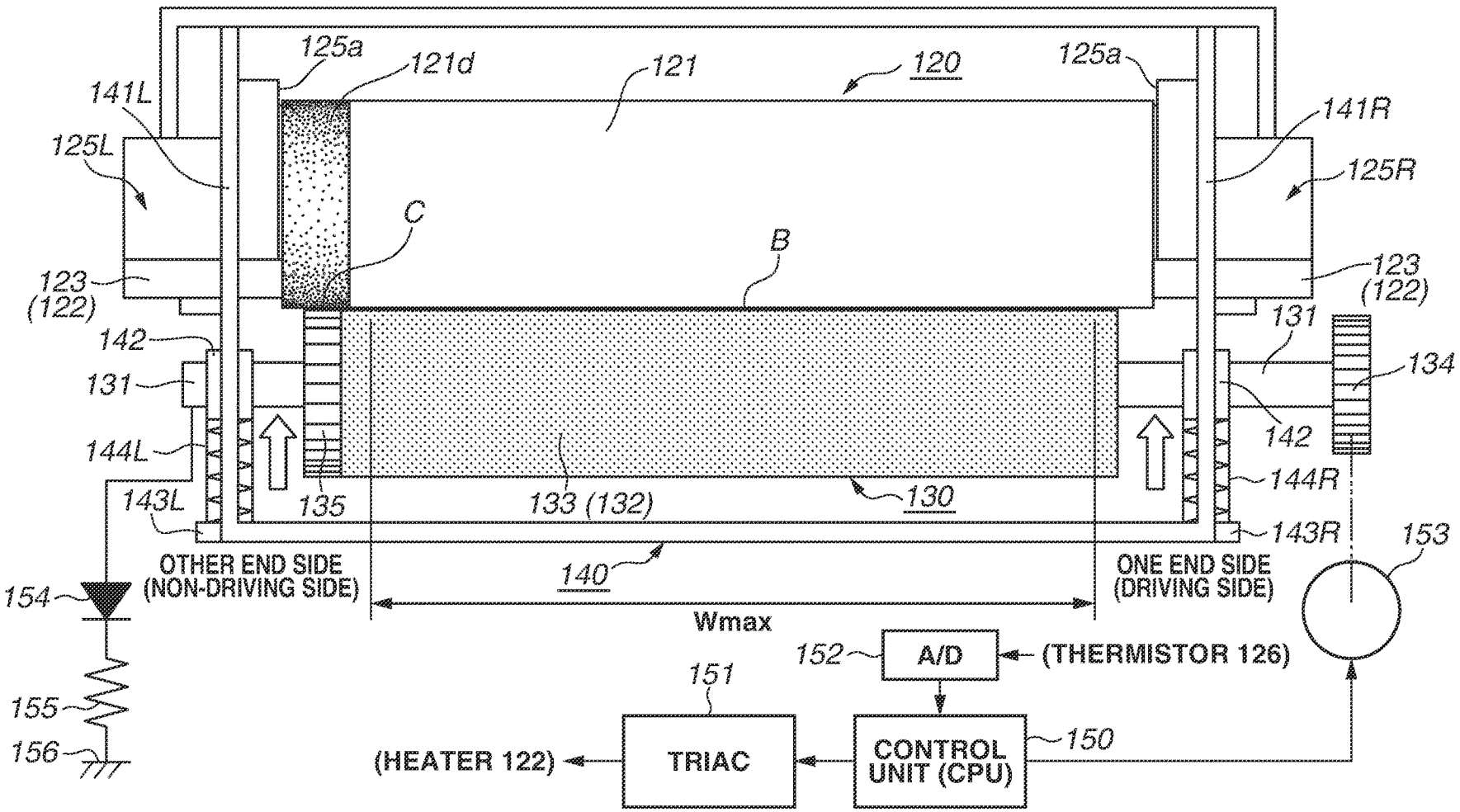
FIG. 11 is a front schematic diagram of the fixing device according to the third exemplary embodiment.
Figure 12:
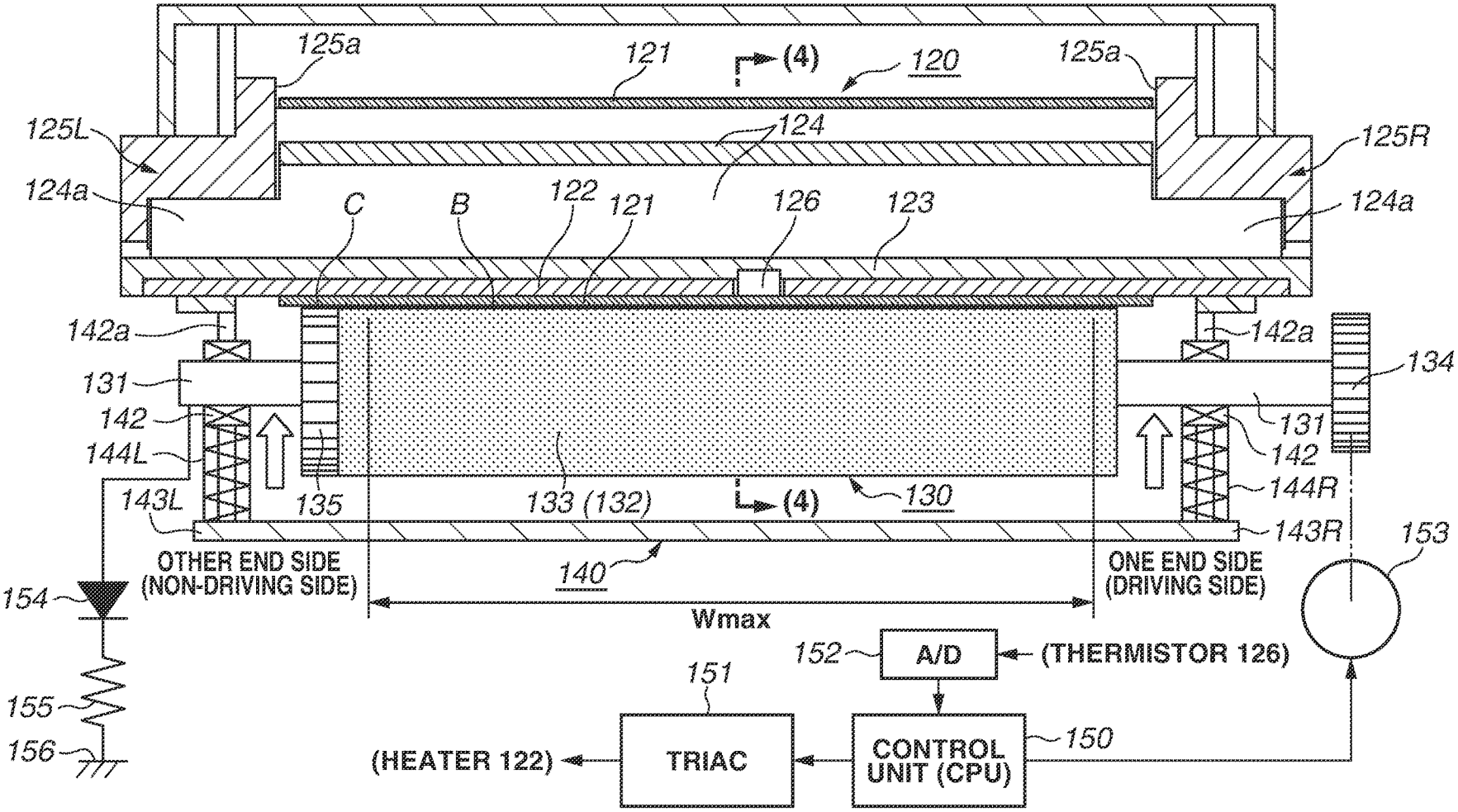
FIG. 12 is a cutaway front schematic diagram of the fixing device.
Figure 13:
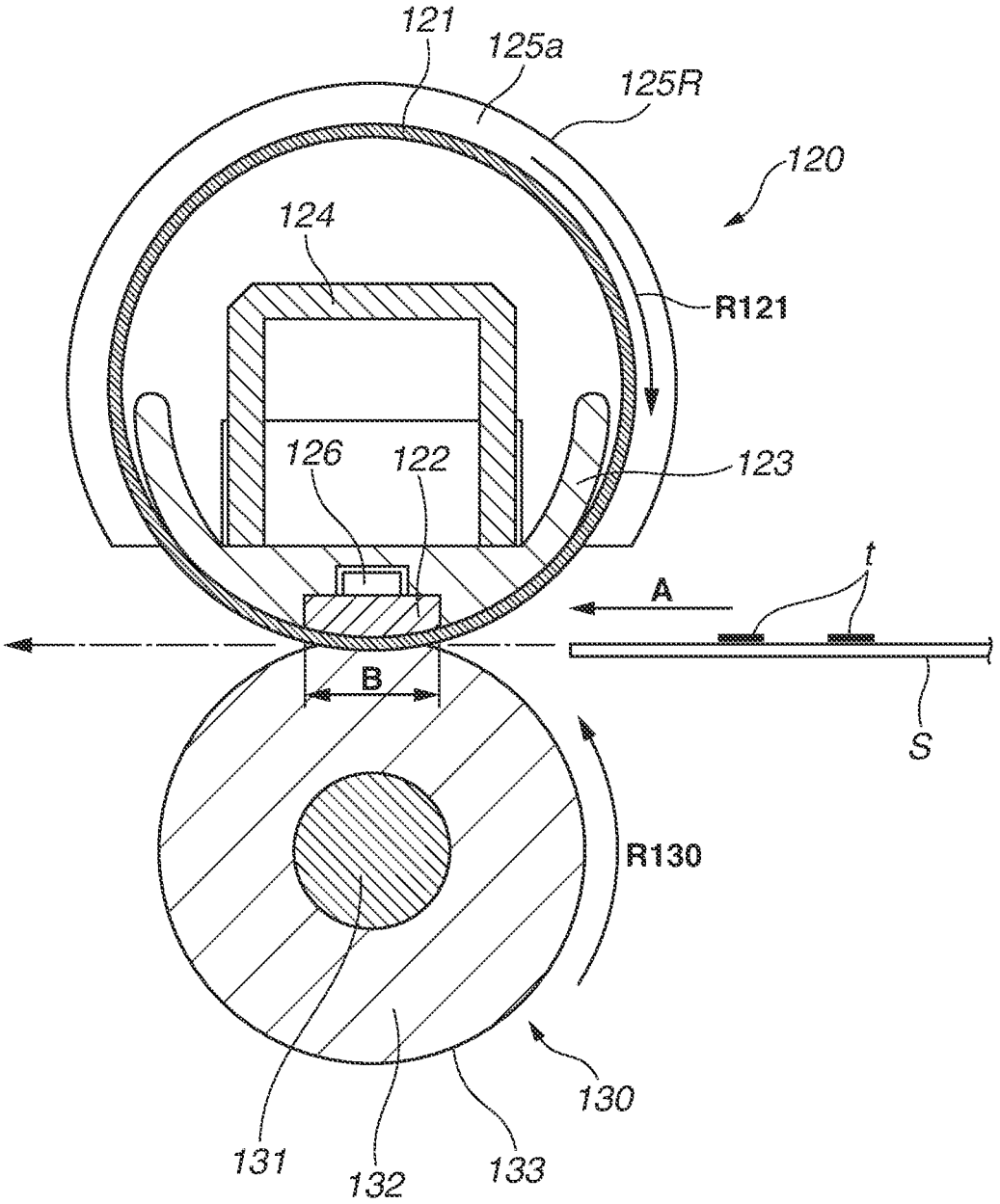
FIG. 13 is an enlarged schematic cross-sectional view along a line (4)-(4) in a direction of arrows in FIG. 12.

The fixing device 113 according to the present exemplary embodiment is an image heating device (an on-demand fixing device (ODF)) using a film (belt) heating method for the purpose of shortening the start-up time and achieving low power consumption. FIG. 11 is a front schematic diagram of the fixing device 113 according to the present exemplary embodiment. FIG. 12 is a cutaway front schematic diagram of the fixing device 113. FIG. 13 is an enlarged schematic cross-sectional view along a line (4)-(4) in the direction of arrows in FIG. 12.

The fixing device 113 mainly includes a film unit (belt unit) 120, a pressure roller 130 as a driving rotating member having elasticity, and a device frame member (chassis or housing) 140, which accommodates the film unit 120 and the pressure roller 130.

The film unit 120 includes a fixing film (hereinafter referred to as "film") 121, which is an endless (cylindrical) rotatable belt having flexibility and loosely externally fit to internal assemblies (internal members). Within the film 121, a heating heater (hereinafter referred to as "heater") 122 as a heating member, a heater holder (hereinafter referred to as "holder") 123 as a holding member for holding the heater 122, and a stay 124, which supports the holder 123, are disposed as the internal assemblies.

Each of the heater 122, the holder 123, and the stay 124 is a member having a length longer than the width (length) of the film 121, and one end side and the other end side of each member protrude outward from both end portions of the film 121. Then, flange members 125R and 125L on one end side and the other end side are fit to outward protruding portions 124*a* on one end side and the other end side, respectively, of the stay 124. The flange members 125R and 125L are molded products made of a heat-resistant resin and shaped symmetrically to each other.

The film 121 is loosely externally fit to the outside of the internal assemblies 122 to 124 such that the movement of the film 121 in the width direction is restricted by opposed flange surfaces (flange bases) 125*a* and 125*a* of the flange members 125R and 125L, which are fit to both end portions of the stay 124.

(1) Film

Figure 14:
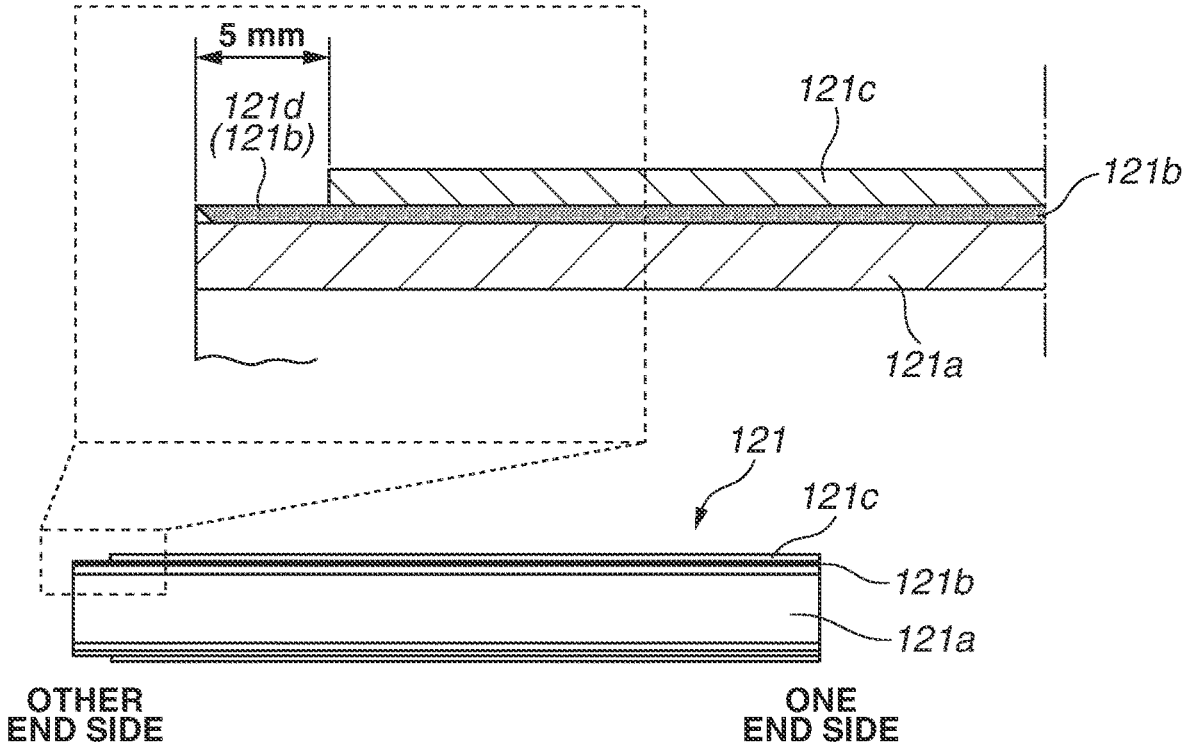
FIG. 14 is a diagram illustrating a layer configuration of a film.

The film 121 according to the present exemplary embodiment, which has flexibility, is almost cylindrical (tubular) due to the elasticity of the film 121 itself in a free state. Then, the film 121 has an outer diameter of 20 mm and has a multi-layered configuration in the thickness direction. FIG. 14 is a schematic diagram illustrating the layer configuration of the film 121. As the layer configuration, the film 121 includes a cylindrical base layer 121*a*, which maintains the strength of the film 121, a conductive primer layer 121*b*, which is disposed on the outer circumferential surface of the base layer 121*a*, and a release layer 121*c*, which is further disposed outside the conductive primer layer 121*b* and reduces the attachment of dirt to the surface of the film 121.

The material of the base layer 121*a* requires heat resistance because the base layer 121*a* receives heat from the heater 122, and also requires strength because the base layer 121*a* slides in contact with the heater 122. Thus, a metal such as stainless used steel (SUS: stainless steel) or nickel, or a heat-resistant resin such as polyimide may be used. A metal is stronger than a resin and therefore allows the base layer 121*a* to be thinned. Further, a metal also has high thermal conductivity and therefore facilitates the transmission of heat from the heater 122 to the surface of the film 121. On the other hand, a resin has a smaller specific gravity than a metal and therefore has the advantage of easily warming up due to small heat capacity. Further, a resin can be used to mold a thin film by coating molding, and therefore, the base layer 121*a* can be molded inexpensively.

In the present exemplary embodiment, a polyimide resin is used as the material of the base layer 121*a* of the film 121 and used by adding a carbon filler to the polyimide resin to improve the thermal conductivity and the strength. The smaller the thickness of the base layer 121*a*, the more easily heat from the heater 122 is transmitted to the surface of the film 121. In this case, however, the strength of the base layer 121*a* decreases. Thus, it is desirable that the thickness of the base layer 121*a* should be about 20 μm to 100 μm.

The conductive primer layer 121*b* as a conductive layer is made of a polyimide resin or a fluororesin, and carbon is added to the resin, thereby achieving low resistance. When a sheet is passed through the fixing device 113, a conductive layer exposed portion 121*d*, which is an exposed portion of the conductive primer layer 121*b* and is disposed annularly on the other end side of the film 121, is connected to the ground via an annular conductive rubber ring 135, which is a conductive elastic body disposed on the pressure roller 130 side. This stabilizes the potential of the film 121. This will be described below.

It is desirable that as the material of the release layer 121*c*, a fluororesin such as a perfluoroalkoxy resin (PFA), a polytetrafluoroethylene resin (PTFE), or a tetrafluoroethylene-hexafluoropropylene resin (FEP) should be used. In the present exemplary embodiment, among fluororesins, PFA, which has excellent release properties and heat resistance, is used, and a conductive material is dispersed in the PFA, thereby achieving medium resistance.

The release layer 121*c* may be obtained by covering a tube, or may be obtained by coating a surface with a coating material. In the present exemplary embodiment, the release layer 121*c* is molded by coating excellent in thin molding. The thinner the release layer 121*c*, the more easily heat from the heater 122 is transmitted to the surface of the film 121. If, however, the release layer 121*c* is too thin, the durability of the release layer 121*c* decreases. Thus, it is desirable that the thickness of the release layer 121*c* should be about 5 μm to 30 μm. In the present exemplary embodiment, the thickness of the release layer 121*c* is 10 μm.

To bring the conductive rubber ring 135 into contact with the conductive primer layer 121*b* to obtain conduction, in a longitudinal end portion having a width of 5 mm on the other end side of the film 121, the release layer 121*c* is not molded, and the conductive layer exposed portion 121*d* is formed, in which the conductive primer layer 121*b* is exposed in the circumferential direction of the film 121.

(2) Heater

As the heater 122 according to the present exemplary embodiment, a general heater which is used in a heating device using a film heating method and in which a resistance heating element is provided in series on a substrate made of ceramics is employed.

More specifically, the heater 122 includes a heat-resistant insulating substrate made of alumina or aluminum nitride and having excellent thermal conductivity. On the surface of this substrate, the heater 122 includes an electrical resistance layer made of an electrical resistance material such as silver-palladium (Ag/Pd) applied by screen printing and having a thickness of about 10 μm and a width of 1 to 3 mm. Further, on this electrical resistance layer, the heater 122 includes a protection layer made of glass or a fluororesin applied by coating. On the back surface of the heater 122, a thermistor 126 as a temperature detection unit is placed.

The heater 122 receives the supply of power via an electrical connector (not illustrated) from a triode for alternating current (TRIAC) 151 as a current application control unit controlled by a control unit (control circuit unit: CPU) 150, and a predetermined effective entire length region of the resistance heating element rapidly generates heat. The temperature of the heater 122 is sent as an output signal (a temperature detection signal) of the thermistor 126 to the control unit 150 through an analog-to-digital (A/D) converter 152.

Based on the temperature detection signal, the control unit 150 controls, by phase control or wave number control, power to be applied to the heater 122 by the TRIAC 151 and controls the temperature of the heater 122. If the temperature of the heater 122 is lower than a predetermined setting temperature (target temperature), the control unit 150 controls the TRIAC 151 to raise the temperature of the heater 122. If the temperature of the heater 122 is higher than the setting temperature, the control unit 150 controls the TRIAC 151 to lower the temperature of the heater 122. Consequently, the control unit 150 maintains the heater 122 at the setting temperature.

(3) Holder and Stay

It is desirable that the holder 123 should be made of a material having low heat capacity so that it is difficult for the holder 123 to draw heat from the heater 122. In the present exemplary embodiment, a liquid-crystal polymer (LCP), which is a heat-resistant resin, is used. The holder 123 is supported by the stay 124, which is made of iron, from the opposite side of the heater 122 so that the holder 123 has strength.

(4) Pressure Roller

The pressure roller 130 includes a metal core 131, a heat-resistant elastic layer 132, which is provided concentrically in a roller manner around the outer circumference of the metal core 131, and a release layer 133, which is further formed on the elastic layer 132.

The metal core 131 is made of a metal such as SUS and is 8.5 mm in diameter. The elastic layer 132 is made of heat-resistant rubber such as silicone rubber or fluororubber, which has insulation properties, or an elastic body formed by foaming heat-resistant rubber. The elastic layer 132 can be formed of a sponge-like elastic material including fine holes, such as a sponge rubber layer or a foamed rubber layer.

Then, the release layer 133, which is made of a fluororesin such as PFA, PTFE, or FEP, is formed around the outer circumference of the elastic layer 132. In the present exemplary embodiment, as the pressure roller 130, an elastic pressure roller is used in which an elastic roller portion has an outer diameter of 14.0 mm and a hardness of 40° (Asker C, with a load of 600 g).

On one end side of the metal core 131 of the pressure roller 130, a driving gear 134 is disposed concentrically with the metal core 131. Further, on the other end side of the metal core 131, the annular conductive rubber ring 135, which is a conductive elastic body (a conductive elastic member), is fit adjacent to the elastic roller portion. The conductive rubber ring 135 will be described below.

(5) Pressurization Configuration

The film unit 120 and the pressure roller 130 are arranged parallel to each other and disposed between side plates 141R and 141L on one end side and the other end side, respectively, of the device housing 140. In the film unit 120, the flange members 125R and 125L on one end side and the other end side are positioned at predetermined positions relative to the side plates 141L and 141R and fixedly supported by the side plates 141R and 141L, respectively.

Thus, the heater 122, the holder 123, and the stay 124, which are the internal assemblies of the film unit 120, are also fixedly supported between the side plates 141R and 141L.

In the pressure roller 130, one end side and the other end side of the metal core 131 are rotatably supported by the side plates 141R and 141L, respectively, through bearing members 142. The heater 122 of the film unit 120 is opposed to the pressure roller 130 through the film 121. The bearing members 142 on one end side and the other end side are engaged with guide slit portions 142*a* and 142*a*, which are formed in the side plates 141R and 141L on the respective sides.

The guide slit portions 142*a* and 142*a* guide the bearing members 142 in a sliding manner in a direction toward the film unit 120 and a direction away from the film unit 120. Thus, the pressure roller 130 has a degree of freedom where the entirety of the pressure roller 130 can move in a direction toward the film unit 120 and a direction away from the film unit 120 along the guide slit portions 142*a* and 142*a* between the side plates 141R and 141L.

Then, a pressure spring 144R is provided in a contracted manner between the bearing member 142 on one end side and a spring reception base 143R on one end side of the device frame member 140. Similarly, a pressure spring 144L is provided in a contracted manner between the bearing member 142 on the other end side and a spring reception base 143L on the other end side of the device frame member 140.

By the reaction forces of the pressure springs 144R and 144L due to their provision in a contracted manner, respective predetermined equivalent pressing forces act on the bearing members 142 on one end side and the other end side. Consequently, the pressure roller 130 is biased against the film unit 120, and the pressure roller 130 comes into pressure contact with the heater 122 with a predetermined pressure force through the film 121 against the elasticity of the elastic layer 132. Thus, as illustrated in FIG. 13, a fixing nip portion B having a predetermined width in the sheet conveying direction A is formed between the film 121 and the pressure roller 130.

In the fixing device 113 according to the present exemplary embodiment, the heater 122 or the heater 122 and the holder 123 function as a backup member for coming into contact with the inner surface of the film 121.

(6) Fixing Operation

The driving force of the motor 153, which is controlled by the control unit 150, is transmitted to the gear 134 of the pressure roller 130 through the drive transmission portion, whereby the pressure roller 130 is driven to rotate as a driving rotating member in the direction of an arrow R130 in FIG. 13 at a predetermined circumferential speed. By the rotation of the pressure roller 130, a rotational force acts on the film 121 by the frictional force between the film 121 and the pressure roller 130 in the fixing nip portion B. Consequently, the film 121 is driven to rotate in the direction of an arrow R121 at a circumferential speed almost corresponding to the circumferential speed of the rotation of the pressure roller 130, while the inner surface of the film 121 slides in close contact with the surface of the heater 122.

Meanwhile, the heater 122 receives the supply of power from the TRIAC 151, which is controlled by the control unit 150, and the heater 122 rapidly generates heat. The temperature of the heater 122 is detected by the thermistor 126, and detected temperature information is input to the control unit 150. According to the input detected temperature information, the control unit 150 appropriately controls a current to be applied from the TRIAC 151 to the heater 122, thereby raising the temperature of the heater 122 to a predetermined temperature and adjusting the temperature so that the predetermined temperature is maintained.

As described above, the pressure roller 130 is driven to rotate, the film 121 is driven to rotate according to the rotation of the pressure roller 130, and the heater 122 is raised to the predetermined temperature to adjust the temperature. In this state, a sheet S, which bears an unfixed toner image t, is introduced from the transfer nip portion 111 side into the fixing nip portion B. The sheet S is introduced into the fixing nip portion B such that the surface of the sheet S on which the toner image t is borne faces the film 121. Then, the sheet S is nipped and conveyed. Consequently, the unfixed toner image t on the sheet S is heated and pressurized, and is fixed as a fixedly attached image. The sheet S having passed through the fixing nip portion B self-strips from the surface of the film 121, and is discharged and conveyed from the fixing device 113.

In the image forming apparatus 100 and the fixing device 113 according to the present exemplary embodiment, the sheet S in various width sizes is conveyed based on so-called center reference, in which the center of the width of the sheet is used as a reference. The device may be configured such that the sheet S is conveyed based on so-called one-side reference, in which one end side in the width direction of the sheet is used as a reference. In FIGS. 11 and 12, Wmax represents the width of a region where a sheet of a maximum width size that can be used in the device 113 is passed.

(7) Configuration for Grounding Surface of Film

As described above, on the other end side of the film 121, the conductive layer exposed portion (conductive surface) 121*d*, which is an exposed portion of the conductive primer layer 121*b*, is disposed annularly in the circumferential direction of the film 121. On the pressure roller 130 side, in a portion located corresponding to the conductive layer exposed portion 121*d* of the film 121, the annular (ring-shaped or doughnut-shaped) conductive rubber ring 135 is disposed, which is a conductive elastic body (a conductive elastic member) that comes into contact with the conductive layer exposed portion 121*d*.

Then, the conductive layer exposed portion 121*d* on the film 121 side is grounded via the conductive rubber ring 135 on the pressure roller 130 side. Consequently, particularly even when a dried sheet having high electrical resistance is passed, the charging of the surface of the film 121 due to the friction between the sheet S and the film 121 is suppressed, thereby stabilizing the potential of the film 121.

Figure 10A:
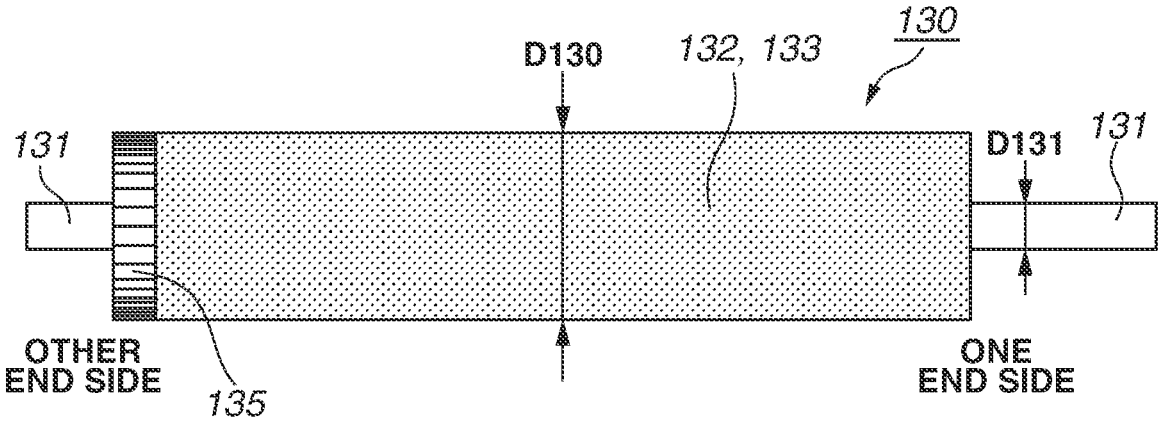
FIGS. 10A and 10B are diagrams illustrating configurations of a pressure roller and a conductive rubber ring of a fixing device according to a third exemplary embodiment.
Figure 10B:
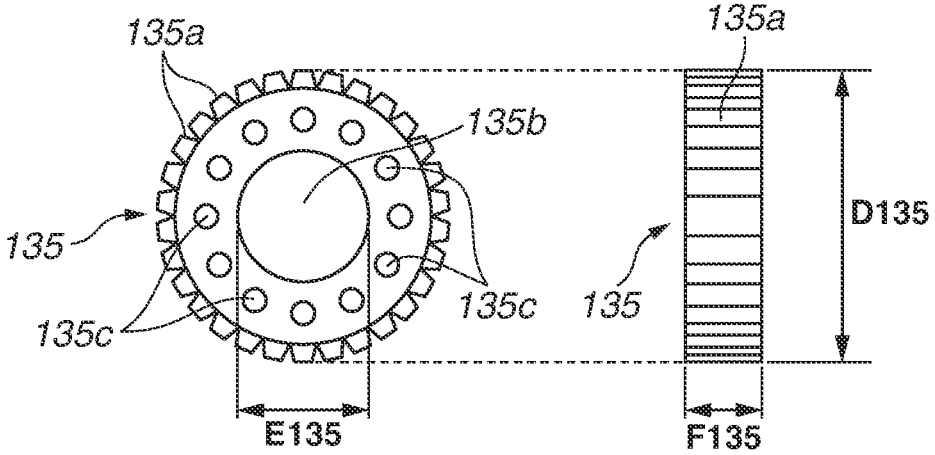

FIG. 10A is a front view of the pressure roller 130 according to the present exemplary embodiment, in which the conductive rubber ring 135 is placed on the metal core 131. FIG. 10B is a schematic diagram illustrating the configuration of the conductive rubber ring 135 alone.

In the present exemplary embodiment, in the free state (an unload state), an outer diameter D130 of the elastic roller portion of the pressure roller 130 is 14.0 mm. An outer diameter D131 of the metal core 131 is 8.5 mm. The conductive rubber ring 135 is fit to the metal core 131 and adjacent to the elastic roller portion on the other end side of the metal core 131. The conductive rubber ring 135 is made of solid conductive silicone rubber of which the resistance is adjusted by mixing silicone rubber with carbon black. The hardness of the conductive elastic member is 23° (JIS-A).

On the outer circumferential surface of the cylinder of the conductive rubber ring 135, a knurling shape (uneven shape) 135*a* is formed. Further, an outer diameter D135 of the conductive rubber ring 135 is 13.8 mm, a diameter (inner diameter) E135 of an inner hole portion 135*b* is 7 mm, and a width F135 of the conductive rubber ring 135 is 3 mm. Further, on an annular surface (a ring-shaped body portion) between the outer diameter and the inner diameter of the conductive rubber ring 135, a plurality of through holes (lightening holes) 135*c* are provided parallel to the thickness direction and also in the circumferential direction of the annular surface. In other words, on the annular surface of the conductive rubber ring 135, a plurality of through holes (lightening holes) 135*c* are provided in a direction parallel to the longitudinal direction of the metal core 131 to which the conductive rubber ring 135 is attached, and also in the circumferential direction of the metal core 131.

The conductive rubber ring 135 is attached to the metal core 131 by externally fitting the inner hole portion 135*b* to the metal core 131. In this case, the inner diameter E135 of the conductive rubber ring 135 is 7 mm, and the outer diameter D131 of the metal core 131 is 8.5 mm. Thus, the conductive rubber ring 135 is attached to the metal core 131 by being externally fit to the metal core 131 with an interference of 1.5 mm for the outer diameter D131 of the metal core 131, namely 8.5 mm, on which the conductive rubber ring 135 is placed.

Consequently, conduction with the metal core 131 is secured in the conductive rubber ring 135, and also the conductive rubber ring 135 is fixed to rotate with the rotation of the metal core 131 without being shifted in the longitudinal direction of the metal core 131. That is, the conductive rubber ring 135 can rotate together with the metal core 131. At this time, the effects of the conductive rubber ring 135 are not influenced by whether the conductive rubber ring 135 is attached in contact with or away from an end surface of the elastic roller portion of the pressure roller 130.

As described above, a pressurization mechanism pressurizes the pressure roller 130 against the film unit 120, and the fixing nip portion B having a predetermined width is formed between the film 121 and the pressure roller 130 against the elasticity of the elastic layer 132. At this time, at a position opposed to the conductive layer exposed portion 121*d* of the film 121, the conductive rubber ring 135 also compressively deforms against its elasticity and forms a nip (hereinafter referred to as "conductive nip portion") C (FIGS. 11 and 12) between the conductive layer exposed portion 121*d* and the conductive rubber ring 135.

The elasticity of the conductive rubber ring 135 compressed in the conductive nip portion C brings the conductive layer exposed portion 121*d* and the conductive rubber ring 135 into contact with each other with certain stress, and electrical conduction is secured between the conductive layer exposed portion 121*d* and the conductive rubber ring 135. Further, the conductive rubber ring 135 is electrically connected to the ground 156 via the pressure roller metal core 131, which is made of a metal, a diode (rectifier) 154, and a safety resistor 155.

Toner used in the present exemplary embodiment is toner capable of being negatively charged. If the surface of the film 121 is positively charged, electrostatic offset is likely to occur due to an electrostatic force. In response, the diode 154 is placed to release an electric charge having a polarity opposite to the charge polarity of toner from the surface of the film 121. As described above, the film 121 is connected to the ground 156 via the conductive layer exposed portion 121*d*, the conductive rubber ring 135, the metal core 131, the diode 154, and the resistor 155, thereby preventing electric charges having a polarity opposite to the charge polarity of toner from being accumulated.

It is known that at this time, if the resistance value between the conductive layer exposed portion 121*d* and the metal core 131 exceeds 1 MΩ, and when sheets S left under a low temperature and low humidity environment and having high resistance are successively passed, electric charges accumulated in the film 121 cannot be removed. Thus, electrostatic offset starts to occur. In response, when the fixing nip portion B is formed by pressure contact between the film 121 and the pressure roller 130, it is necessary to maintain the resistance value between the conductive layer exposed portion 121*d* and the metal core 131 at less than or equal to 1 MΩ.

(8) Experimental Example 1

Table 3 illustrates the contents of the configuration in the present exemplary embodiment and the configuration of a fixing device as a comparative example, which was compared and reviewed with the present exemplary embodiment. The configuration in the present exemplary embodiment is such that as the pressure roller 130, a pressure roller in which the outer diameter D130 of the elastic roller portion is 14 mm is used, and as the conductive rubber ring 135, a conductive rubber ring including the through holes 135*c* illustrated in FIG. 10B is used and attached to the metal core 131.

Figure 16:
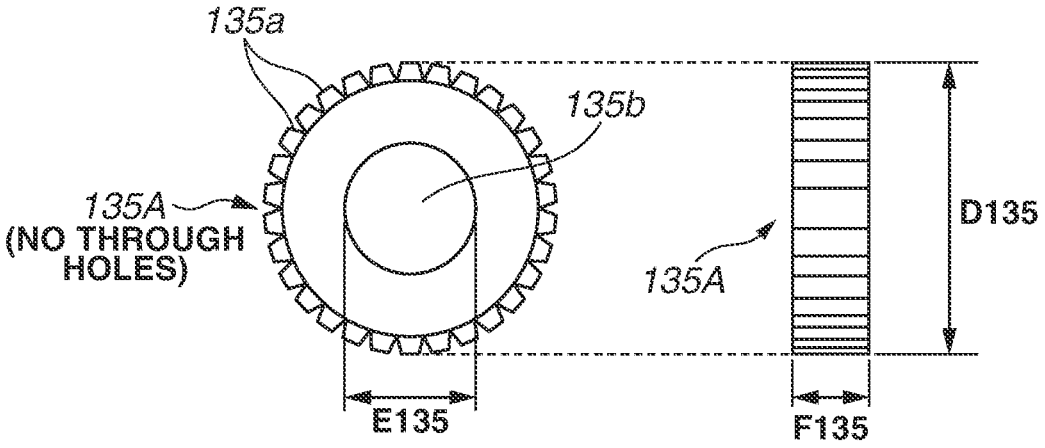
FIG. 16 is a diagram illustrating a configuration of a conductive rubber ring in a comparative example.

On the other hand, the configuration reviewed as the comparative example is such that as a pressure roller, a pressure roller in which similarly, the outer diameter D130 of the elastic roller portion is 14 mm is used, and as a conductive rubber ring, a conductive rubber ring 135A, which includes no through holes as illustrated in FIG. 16, is attached. The conductive rubber ring 135A in FIG. 16 is similar in configuration to the conductive rubber ring 135 illustrated in FIG. 10B, except that the conductive rubber ring 135A includes no through holes 135*c*.

The configuration of the fixing device according to the present exemplary embodiment and the configuration of the fixing device in the comparative example are such that the pressure roller 130 is pressurized to the film 121 side so that the width in the sheet conveying direction A of the fixing nip portion B is 6 mm in both configurations.

TABLE 3

Configurations of Fixing Devices in Exemplary Embodiment and Comparative Example

| | Outer diameter of pressure roller | Conductive rubber ring |
|---|---|---|
| Configuration in present exemplary embodiment | 14 | Through holes included |
| Comparative example | 14 | Through holes not included |

In the conductive rubber ring 135 according to the present exemplary embodiment, the through holes 135*c* are provided to absorb stress, whereby it is possible to stably form the conductive nip portion C. This prevents offset, and defective fixing is also less likely to occur.

Figure 17:
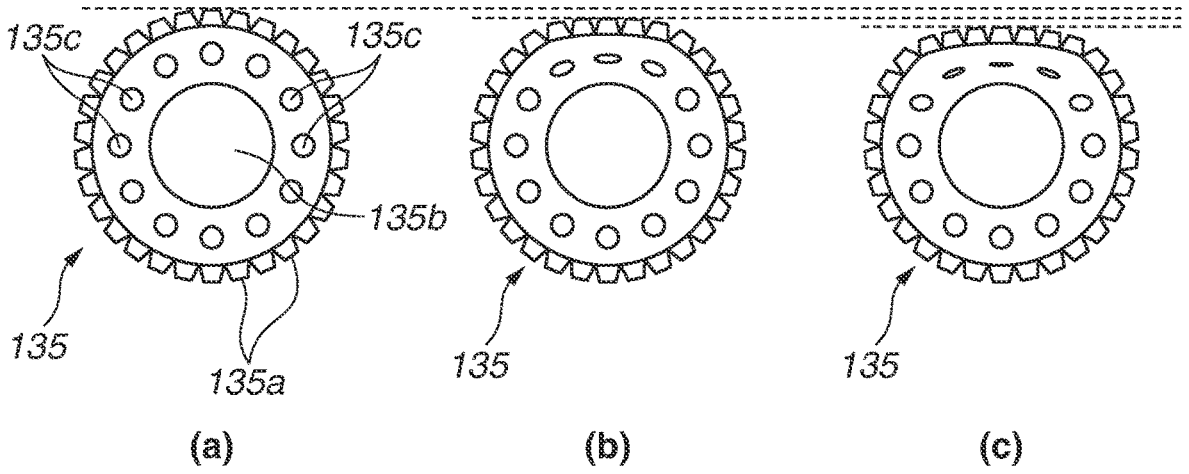
FIG. 17 is a diagram illustrating a variation of the conductive rubber ring according to the exemplary embodiment.

FIG. 17 is a diagram illustrating the states where load is applied to the conductive rubber ring 135 according to the present exemplary embodiment, in which the through holes 135*c* are provided, from the upper surface of the conductive rubber ring 135, thereby compressively deforming the conductive rubber ring 135. The conductive rubber ring 135 according to the present exemplary embodiment is compressively deformed, thereby deforming in the order of (a)→(b)→(c) such that the through holes 135*c* are crushed according to the load.

Figure 18:
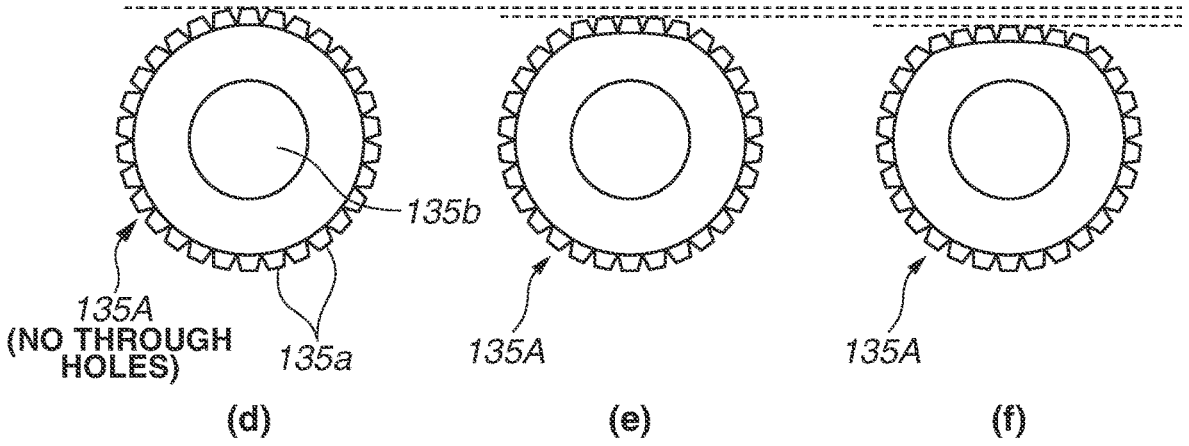
FIG. 18 is a diagram illustrating a variation of the conductive rubber ring in the comparative example.

FIG. 18 is a diagram illustrating the states where load is applied to the conductive rubber ring 135A in the comparative example (FIG. 16), in which no through holes are provided, from the upper surface of the conductive rubber ring 135A, thereby compressively deforming the conductive rubber ring 135A. The conductive rubber ring 135A in the comparative example deforms in the order of (d)→(e)→(f) according to the load.

Figure 19:
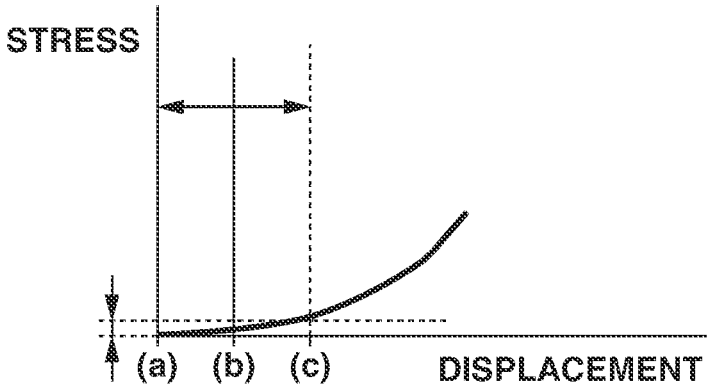
FIG. 19 is a diagram illustrating a relationship between stress and displacement of each of the conductive rubber rings in the exemplary embodiment and the comparative example.
Figure 19:
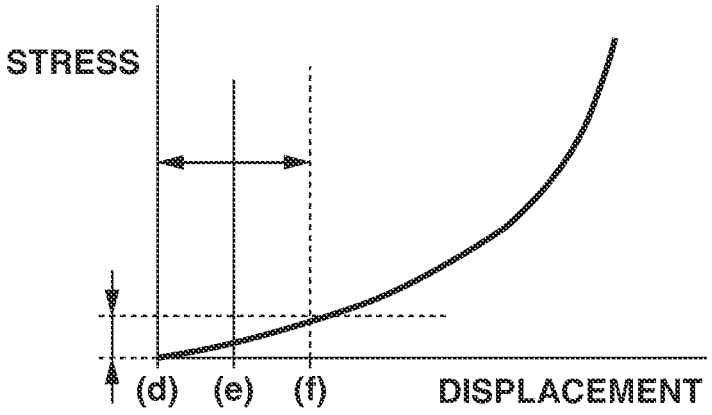

FIG. 19 illustrates changes in stress relative to the displacement of each of the conductive rubber ring 135 according to the present exemplary embodiment and the conductive rubber ring 135A in the comparative example at this time. In FIG. 19, codes "a" to "f" assigned to the levels of displacement on a horizontal axis correspond to codes indicating the states illustrated in FIGS. 17 and 18 where the conductive rubber rings are compressively deformed.

The conductive rubber ring 135 according to the present exemplary embodiment is characterized in that when load is applied to the conductive rubber ring 135 to increase the displacement in the order of (a)→(b)→(c), the through holes 135*c* are crushed, whereby the conductive rubber ring 135 absorbs the resulting stress, and therefore, the conductive rubber ring 135 has a region where a change in stress relative to the displacement becomes small.

A description is given below of an experiment where the effects of the conductive rubber ring 135 according to the present exemplary embodiment were confirmed. Regarding the configuration of the fixing device illustrated in table 3, the fixability and electrostatic offset were evaluated under a low temperature and low humidity (temperature: 15° C., humidity: 10%) environment. As an evaluation sheet, a sheet of Xerox Vitality Multipurpose Paper (letter size, 201b) left for two days under this low temperature and low humidity environment was used.

1) The fixability was evaluated by successively printing a 5-mm square halftone image as a fixing evaluation image on 100 sheets of the above sheet. After the printing, the first to third sheets and the hundredth sheet were extracted as samples from among the 100 sheets, a load of 10 g/cm$^2$ was applied to each sheet, and the reflection density of the sheet before and after the sheet was rubbed against nonwoven fabric was measured using a reflection densitometer (product name: RD918; manufactured by GretagMacbeth). If the difference in reflection density between before and after the sheet is rubbed against nonwoven fabric is greater than 10%, a practical problem arises. Thus, a case where the difference in reflection density was less than or equal to 10% was indicated by "○". A case where the difference in reflection density that exceeded 10% was indicated by "x".

2) Electrostatic offset was evaluated using an evaluation image which is a halftone image obtained by printing isolated single dots at 600 dpi, in which offset was likely to occur, in a portion from a position 5 mm away from the front end of the sheet to a position 20 mm away from the front end of the sheet. Similarly to the above, after printing was successively performed on 100 sheets of Xerox Vitality Multipurpose Paper (letter size, 201b), the first to third sheets and the hundredth sheet were extracted as samples from among the 100 sheets and evaluated. A case where dirt did not occur due to offset toner on a solid white surface in a portion after the position 20 mm away from the front end of the sheet was indicated by "○". A case where dirt occurred due to offset toner on the solid white surface was indicated by "x".

The outer diameter D135 of the conductive rubber ring 135 (135A) can be appropriately adjusted relative to the outer diameter D130 of the elastic roller portion of the pressure roller 130. Thus, the configuration of each fixing device was evaluated by varying the outer diameter D135 of the conductive rubber ring 135 (135A).

The reason why the outer diameter D135 of the conductive rubber ring 135 (135A) influences the fixability is as follows.

As illustrated in FIGS. 11 and 12, the elastic layer 132 and the conductive rubber ring 135 of the pressure roller 130 are formed on and attached to the same metal core 131, and then, the pressure roller 130 is pressurized to the film 121 side, thereby forming the fixing nip portion B having a width of 6 mm in the sheet conveying direction A. Thus, if the outer diameter D135 of the conductive rubber ring 135 is large relative to the outer diameter D130 of the elastic roller portion of the pressure roller 130, the stress acting on the conductive rubber ring 135 becomes great. In this case, the pressure acting on the elastic roller portion of the pressure roller 130 relatively decreases. Thus, a pressure force required to fix an image in the fixing nip portion B becomes insufficient, thereby causing a decrease in the fixability.

Further, the reason why the outer diameter D135 of the conductive rubber ring 135 influences electrostatic offset is as follows.

To prevent electrostatic offset, the conductive rubber ring 135 and the conductive layer exposed portion 121*d* of the film 121 need to maintain contact pressure equal to or greater than certain pressure in the conductive nip portion C. If, however, the outer diameter D135 of the conductive rubber ring 135 is small relative to the outer diameter D130 of the elastic roller portion of the pressure roller 130, the contact pressure between the conductive rubber ring 135 and the conductive layer exposed portion 121*d* becomes too small, or the conductive rubber ring 135 and the conductive layer exposed portion 121*d* are not in contact with each other. In this case, conduction between the conductive rubber ring 135 and the conductive layer exposed portion 121*d* cannot be secured, and electric charges are accumulated in the film 121. Thus, electrostatic offset occurs.

Further, the reason why the fixability and electrostatic offset are evaluated using the first sheet and the hundredth sheet among the successively passed sheets is as follows. The elastic roller portion of the pressure roller 130 is heated when a fixing operation is performed. Thus, the outer diameter of the elastic roller portion becomes larger due to thermal expansion. Then, the thermal expansion of the outer diameter becomes saturated by successively passing about 100 sheets. In contrast, at the position of the conductive nip portion C with which the conductive rubber ring 135 comes into contact, an electrical resistance layer is not provided on the heater 122. Thus, the conductive rubber ring 135 thermally expands only slightly.

The relative relationship between the outer diameter D130 of the pressure roller 130 and the outer diameter D135 of the conductive rubber ring 135 changes according to the heating of the pressure roller 130 by successively passing sheets. Thus, the results of the fixability and electrostatic offset change for the above reasons. The fixing device needs to maintain the state where excellent fixability is obtained, and electrostatic offset does not occur, regardless of the number of printed sheets. To confirm this, the fixability and electrostatic offset were evaluated using the first to third sheets and the hundredth sheet among the successively passed sheets.

Table 4 illustrates the results of the above experiment for confirming the effects of the conductive rubber rings in the present exemplary embodiment and the comparative example.

TABLE 4

Comparison Between Performances of Fixing Devices in Present Exemplary Embodiment and Comparative Example

| | Outer diameter [mm] of pressure roller | Outer diameter [mm] of conductive rubber ring | Fixability | | Electrostatic offset | | Achievement of both fixability and electrostatic offset |
|---|---|---|---|---|---|---|---|
| | | | First to third sheets | Hundredth sheet | First to third sheets | Hundredth sheet | |
| Present exemplary embodiment | 14 | 14.2 | x | x | ○ | ○ | x |
| | | 14 | ○ | ○ | ○ | ○ | ○ |
| | | 13.8 | ○ | ○ | ○ | ○ | ○ |
| | | 13.6 | ○ | ○ | ○ | ○ | ○ |
| | | 13.4 | ○ | ○ | ○ | x | x |
| | | 13.2 | ○ | ○ | ○ | x | x |
| | | 13 | ○ | ○ | x | x | x |
| Comparative example | 14 | 14.2 | x | x | ○ | ○ | x |
| | | 14 | x | ○ | ○ | ○ | x |
| | | 13.8 | x | ○ | ○ | ○ | x |
| | | 13.6 | x | ○ | ○ | ○ | x |
| | | 13.4 | ○ | ○ | ○ | x | x |
| | | 13.2 | ○ | ○ | ○ | x | x |
| | | 13 | ○ | ○ | x | x | x |

These results are described with reference to schematic diagrams in FIG. 20, which illustrate three contact states occurring due to the differences in stress acting on the conductive rubber ring 135.

Figure 20:
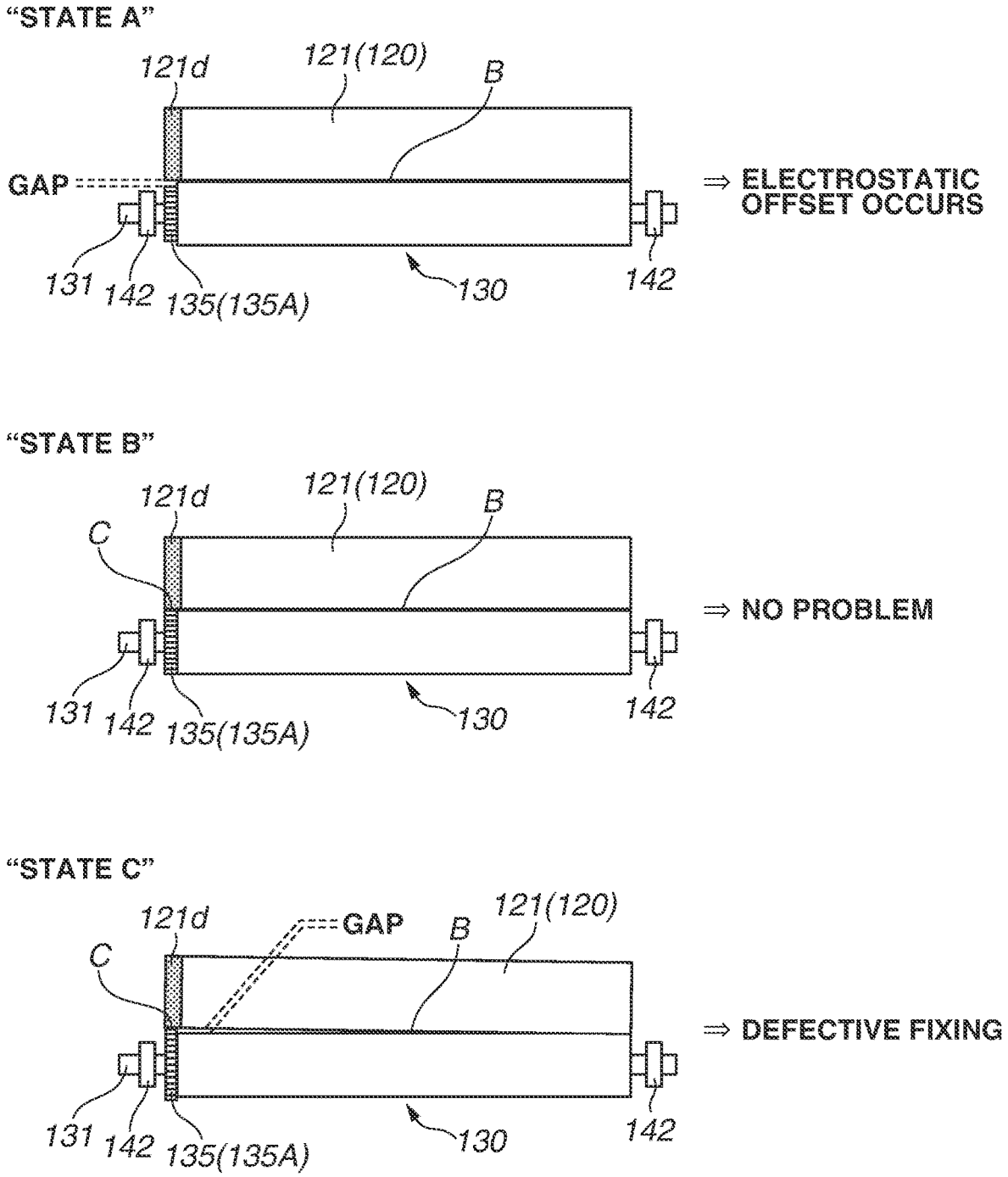
FIG. 20 is diagrams illustrating differences in contact state that occur due to differences in stress acting on each conductive rubber ring.

In FIG. 20, a "state A" is a diagram schematically illustrating an example of the state where electrostatic offset occurs, and the conductive rubber ring 135 and the conductive layer exposed portion 121*d* are not in contact with each other. As described above, if the conductive rubber ring 135 and the conductive layer exposed portion 121*d* are not in contact with each other, or the contact pressure between the conductive rubber ring 135 and the conductive layer exposed portion 121*d* is weak, electric charges accumulated in the film 121 cannot be removed. Thus, electrostatic offset occurs.

A "state B" is the state where the conductive rubber ring 135 and the conductive layer exposed portion 121*d* are in contact with each other with appropriate contact pressure. At this time, no problem arises.

A "state C" is a diagram schematically illustrating an example of the state where the evaluation result of the fixability is indicated by "x", and the contact pressure between the conductive rubber ring 135 and the conductive layer exposed portion 121*d* is too high. In this case, the pressure of the fixing nip portion B between the elastic roller portion of the pressure roller 130 and the film 121 is insufficient. Further, a gap occurs between the pressure roller 130 and the film 121. Thus, defective fixing occurs.

Result of Present Exemplary Embodiment

In the present exemplary embodiment, in which the through holes 135*c* are provided in the conductive rubber ring 135, the outer diameter D135 of the conductive rubber ring 135 was set to 13.6 to 14.0 mm for the outer diameter D130 of the pressure roller 130, namely 14 mm. Consequently, both excellent fixability and the state where electrostatic offset does not occur were achieved. Although the outer diameter D130 of the pressure roller 130 is 14 mm, if the pressure roller 130 is compressively deformed to form the fixing nip portion B, the pressure roller 130 deforms to have a diameter approximately substantially corresponding to an outer diameter of 13.4 mm.

If the diameter D135 of the conductive rubber ring 135 according to the present exemplary embodiment was set to 13.6 to 14.0 mm using the conductive rubber ring 135, the state of the "state B" in FIG. 20 was maintained even by passing the first to hundredth sheets. Thus, no problem arose.

Result of Comparative Example

In the conductive rubber ring 135A in the comparative example, for example, if a conductive rubber ring having an outer diameter of 13.2 mm was used, no problem arose in the first to third sheets, but electrostatic offset occurred in the hundredth sheet. This is because when an image was fixed to the first sheet, the conductive rubber ring 135A and the conductive layer exposed portion 121*d* were in the state of the "state B" in FIG. 20, but when an image was fixed to the hundredth sheet, the outer diameter of the pressure roller 130 became larger due to thermal expansion. That is, the conductive rubber ring 135A and the conductive layer exposed portion 121*d* entered the state of the "state A" in FIG. 20, where the outer diameter D135 of the conductive rubber ring 135A was small relative to the outer diameter D130 of the pressure roller 130.

Further, for example, when a conductive rubber ring 135A having an outer diameter D135 of 13.6 mm was used, defective fixing occurred in the first to third sheets. This is because due to the relationship between the outer diameter of the conductive rubber ring 135A, which was 13.6 mm, and the outer diameter of the pressure roller 130 (13.4 mm) when pressurized, the conductive rubber ring 135A and the conductive layer exposed portion 121*d* were in the "state C" in FIG. 20. In this state, when an image was fixed to the hundredth sheet, the pressure roller 130 was thermally expanded. Thus, the state where stress concentrated on the conductive rubber ring 135A in the "state C" was resolved, and the conductive rubber ring 135A and the conductive layer exposed portion 121*d* entered the "state B".

As a result, in the conductive rubber ring 135 according to the present exemplary embodiment, a fixed image having no problem with both the fixability and offset was obtained by using a conductive rubber ring having an outer diameter D135 of 13.6 to 14.0 mm. On the other hand, in the conductive rubber ring 135A in the comparative example, the level on which image defect did not occur was not obtained even by varying the outer diameter in various sizes.

In the present exemplary embodiment, an example has been described where the circular through holes 135*c* are provided on the same circumference. Alternatively, even if a plurality of through-holes 135*c* of different sizes are provided, or holes other than cylindrical holes are provided, it is possible to obtain similar effects.

Further, the through holes 135*c* can also be appropriately placed. If the through holes 135*c* are placed at positions corresponding to a portion immediately below the protruding portion of the knurling shape 135*a* on the surface, a portion for receiving stress and a portion for absorbing stress become close to each other, and therefore, it is possible to quickly absorb stress, which is desirable. This configuration can be easily achieved by changing the shape of a die for molding the conductive rubber ring.

As the elastic layer 132 of the pressure roller 130, any of a solid rubber layer, a sponge rubber layer obtained by foaming silicone rubber, and an air bubble rubber layer obtained by dispersing a hollow filler in silicone rubber to provide air bubble portions in a cured product is effective. Among these layers, particularly in the case of a sponge-like elastic layer including fine holes, such as a sponge rubber layer or an air bubble rubber layer, the displacement of the layer is great when the layer is pressurized to form the fixing nip portion B. Thus, the effects of the conductive rubber ring according to the present disclosure are great.

In the above exemplary embodiment, the conductive layer exposed portion (conductive surface) 121*d* is placed on the other end side of the film 121. The present disclosure, however, is not limited to this. Alternatively, the conductive layer exposed portion 121*d* may be placed on one end side of the film 121. The conductive layer exposed portion 121*d* can be provided in at least part of the film 121 along the circumferential direction.

Further, in the exemplary embodiment, the configuration is such that the film 121 is grounded via the conductive rubber ring 135 and the metal core 131. The present disclosure, however, is not limited to this. The effects of the present exemplary embodiment are similar also in a configuration in which a voltage of the same polarity as the charge polarity of toner is applied to the conductive layer exposed portion 121*d* of the film 121 via the conductive rubber ring 135 and the metal core 131. That is, the device can also be configured to include a power supply unit (not illustrated) for applying a voltage of the same polarity as the charge polarity of toner to the conductive layer exposed portion 121*d* of the film 121 via the metal core 131 and the conductive rubber ring 135.

<Other Matters>

(1) The device can also be configured such that the pressurization configuration of the film unit 120 and the pressure roller 130 for forming the fixing nip portion B is such that the film unit 120 is pressurized against the pressure roller 130. The device can also be configured such that both the film unit 120 and the pressure roller 130 are pressurized against each other. That is, the pressurization mechanism only needs to be configured to pressurize at least one of the film unit 120 and the pressure roller 130 against the other.

(2) The device can also be configured such that in the film unit 120, the film 121 is stretched tightly around and supported by a plurality of suspension members, and the film 121 is rotated by the pressure roller 130 or a driving rotating member other than the pressure roller 130.

(3) The backup member of the film 121 may be a member other than the heater 122.

(4) A heating unit of the film 121 as a rotating member for heating the sheet S bearing the image t is not limited to the heater 122 according to the exemplary embodiment. An appropriate heating configuration such as an internal heating configuration, an external heating configuration, a contact heating configuration, or a non-contact heating configuration using another heating unit such as a halogen heater or an electromagnetic induction coil can be employed.

(5) The rotating member for heating the sheet S bearing the image t is not limited to the form of the film according to the exemplary embodiment, and may be a roller member.

(6) In the exemplary embodiment, a description has been given using an example where the image heating device is a fixing device for heating and fixing an unfixed toner image formed on a recording material. The present disclosure, however, is not limited to this. The present disclosure can also be applied to a device (a glossiness improvement device) for reheating a toner image fixed or temporarily fixed to a recording material, thereby increasing the gloss (glossiness) of an image.

(7) The image forming apparatus is not limited to an image forming apparatus for forming a monocolor image as in the exemplary embodiment. Alternatively, the image forming apparatus may be an image forming apparatus for forming a color image. Further, the image forming apparatus can be implemented in various applications such as a copying machine, a fax, and a multifunction peripheral having a plurality of functions of these apparatuses by adding a necessary device, necessary equipment, and a necessary housing structure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and function.

What is claimed is:

1. A fixing device for fixing a toner image on a recording material, the fixing device comprising:

a heating rotating member including a conductive layer; and a roller configured to rotate about a rotational axis, the roller including:

a metal core;

an elastic portion provided outside the metal core, the elastic portion forming a nip portion with the heating rotating member by contacting with an outer surface of the heating rotating member to be elastically deformed, wherein the toner image is fixed on the recording material while the recording material on which the toner image is formed is being conveyed and heated in the nip portion; and an annular conductive member provided outside the metal core so as to connect with the metal core electrically, the annular conductive member being arranged next to the elastic portion in a direction of the rotational axis, the annular conductive member being contact with the conductive layer of the heating rotating member so as to be deformed elastically, the annular conductive member being provided with a plurality of holes penetrating the annular conductive member in the direction of the rotational axis, wherein the conducive layer of the heating rotating member is grounded via the annular conducive member and the metal core.

2. The fixing device according to claim 1, wherein the annular conductive member is made of solid silicone rubber containing carbon black.

3. The fixing device according to claim 1, wherein the elastic portion of the roller includes an elastic layer made of a solid rubber and a toner release layer that is formed outside the elastic layer and is made of a perfluoroalkoxy resin.

4. The fixing device according to claim 1, wherein the heating rotating member includes a surface layer disposed outside the conducive layer to form an exposed portion, where the conductive layer is exposed, at an end portion of the heating rotating member in the direction of the rotational axis, and wherein the annular conducive member is disposed at an end portion of the roller on a side of the exposed portion of the heating rotating member in the direction of the rotational axis, and contacts with the exposed portion of the heating rotating member.

5. The fixing device according to claim 1, wherein the annular conductive member is fixed to the metal core so as to rotate with the metal core.

6. The fixing device according to claim 1, wherein the metal core is electrically connected to a ground via a diode and a resistor.

7. The fixing device according to claim 1, wherein the conductive layer is made of a polyimide resin containing a carbon filler.

8. The fixing device according to claim 1, wherein a hardness of the annular conductive member is smaller than a hardness of a surface of the elastic portion of the roller.

9. The fixing device according to claim 1, wherein the heating rotating member is a cylindrical film.

10. The fixing device according to claim 9, further comprising:

a heater configured to contact with the cylindrical film.

11. The fixing device according to claim 10, wherein the roller is configured to form the nip portion in cooperation with the heater through the cylindrical film.

12. The fixing device according to claim 9, further comprising:

a heater configured to heat the cylindrical film, the heater being provided in an inner space of the cylindrical film, wherein the roller is configured to form the nip portion in cooperation with the heater through the cylindrical film.

13. The fixing device according to claim 1, wherein an outer circumferential surface of the annular conductive member has uneven shape.

14. The fixing device according to claim 1, wherein the elastic portion is formed of a sponge-like elastic material including fine holes.

15. The fixing device according to claim 1, wherein the cylindrical film includes a base layer made of a polyimide resin, a surface layer outside the base layer and made of a perfluoroalkoxy resin, a polytetrafluoroethylene resin, or a tetrafluoroethylene-hexafluoropropylene resin, wherein the conductive layer is provided between the base layer and the surface layer, and is made of a polyimide resin containing carbon or a fluororesin containing carbon, and wherein a part of the conductive layer is exposed outside to contact with the annular conductive member of the roller.

* * * * *